United States Patent [19]

Clark et al.

[11] Patent Number: 5,050,108

[45] Date of Patent: Sep. 17, 1991

[54] METHOD FOR EXTENDING THE USEFUL LIFE OF BOILER TUBES

[75] Inventors: Kimble J. Clark, Los Altos; Kevin G. Hara, Fremont; Clayton Q. Lee, Mountain View; Richard S. Moser, San Lorenzo; Terry W. Rettig, Los Altos, all of Calif.

[73] Assignee: Aptech Engineering, Inc., Sunnyvale, Calif.

[21] Appl. No.: 444,043

[22] Filed: Nov. 30, 1989

[51] Int. Cl.[5] ..... G01B 17/00; G01K 17/00; G01N 9/24; F28F 27/00

[52] U.S. Cl. ..... 364/551.01; 364/510; 364/557; 73/622; 122/511; 122/DIG. 13; 138/37; 138/97; 165/96

[58] Field of Search ..... 364/506-510, 364/550, 551.01, 557, 571.03; 73/804-806, 622, 637, 638, 629, 1 J, 834, 865.6; 122/175, 379, 459, 32, 379, 511, 512, DIG. 11, DIG. 13, DIG. 14; 138/36-38, 97, DIG. 6; 165/96, 76; 60/657, 658

[56] References Cited

U.S. PATENT DOCUMENTS

| | | | |
|---|---|---|---|
| 4,231,419 | 11/1980 | Gugel | 138/97 X |
| 4,505,232 | 3/1985 | Usami et al. | 122/511 |
| 4,628,870 | 12/1986 | Draper et al. | 122/32 |
| 4,669,310 | 6/1987 | Lester | 73/1 J X |
| 4,685,334 | 8/1987 | Latimer | 73/622 X |
| 4,713,870 | 12/1987 | Szalvay | 138/97 X |
| 4,716,767 | 1/1988 | Krawchuk | 73/834 |
| 4,792,912 | 12/1988 | Kuramoto et al. | 364/557 |
| 4,908,775 | 3/1990 | Palusamy et al. | 364/551.01 X |
| 4,941,512 | 7/1990 | McParland | 138/97 |

OTHER PUBLICATIONS

Aptech Engineering Services, Inc., "A Method for Optimization of Performance, Increased Life, and Reduced Maintenance of Superheater and Reheater Tubes and Headers", Dec. 1988 (Proposal).

Aptech Engineering Services, Inc., "Optimization of Performance and Life Extension of Superheater and Reheater Tubes and Headers", Mar. 1988 (Proposal).

Aptech Engineering Services, Inc., "Validation and Demonstration of a Method for Optimization of Performance, Increased Life, and Reduced Maintenance of Superheater and Reheater Tubes and Heaters", Mar. 1989 (Proposal).

*Primary Examiner*—Parshotam S. Lall
*Assistant Examiner*—E. J. Pipala
*Attorney, Agent, or Firm*—Limbach, Limbach & Sutton

[57] ABSTRACT

A method for increasing the reliability and remaining useful life of a system of boiler tubes. The present condition of boiler tubes is ascertained and a temperature profile is developed. Additional operating parameters are obtained and used to model the tube system. The model is manipulated to predict a modification which will cause increased tube system life and reliability. The tubes are modified according to the model.

16 Claims, 16 Drawing Sheets

FIG. 2a

METHOD FOR EXTENDING THE USEFUL LIFE OF BOILER TUBES

FIELD OF THE INVENTION

The present invention relates to boiler tube assemblies, and more particularly, to a method for analyzing the current condition of boiler tubes and then modifying them to achieve an increased useful life of the boiler assembly.

BACKGROUND

In a typical fossil-fired boiler, tube outlet steam temperatures and tube metal temperatures are not uniform throughout the tube circuits. While the bulk steam temperature at the tube circuit outlet header may typically be 1005° F., the local steam temperatures in some of the tubes can be as much as 150° F. higher or lower than the bulk temperature. These temperature variations typically occur both across the tube circuit from left to right and through each tube assembly in the direction of the gas flow. The cause of these variations is typically a combination of nonuniform gas velocity and temperature distributions, steam flow imbalance, and intrinsic characteristics of convection pass heat transfer surface arrangements. In general, boiler manufacturers attempt to account for these temperature variations by specifying tube and header materials and thicknesses based upon worst case design conditions.

Under actual operating conditions, a nonuniform tube metal temperature distribution can often lead to metal temperatures in excess of the worst case design in localized areas of the tube circuit. This is generally due to off-design operating conditions, changes from design fuel, and errors in design. These elevated metal temperatures cause tube failures due to high temperature creep. In addition, several other problems are created, such as increased thermal strains that result in header bowing and ligament cracking with premature failures in the associated header components. Decreased thermal performance, boiler efficiency, and reduced life also result.

These undesirable factors have been accepted as typical of operation and characteristic of design. For example, boilers with a tangential firing pattern are usually hotter on one side of the superheater and reheater sections. Front and rear wall fired boilers typically have hot spots at the quarter points on the header. These temperatures are the result of gas side and steam side flow imbalances occurring across the unit that are partially addressed in the original design calculations. However, the reality of the large temperature differences is that tube materials and header geometry have generally not been adequately designed to withstand these differences. For example, material changes are made in a circuit from the inlet to the outlet, but the same materials are used across the unit. Each assembly across a unit is identical even though temperature differences can vary by as much as 150° F. This temperature difference is almost as large as the temperature difference from the inlet to the outlet in a particular tube assembly.

Failures of boiler tubes due to high temperature creep are a leading cause of forced outages in fossil fueled boilers. Often these failures are confined to very localized regions of the tube circuit for the reasons cited above. Furthermore, when the tube failure frequency becomes unacceptably high for the utility, the entire tube circuit is often replaced when, in fact, only a small region of the tube circuit has significant creep damage and the remainder of the tube circuit has substantial remaining life.

FIG. 1 shows a typical profile of the steam temperature at the tube outlet legs of a superheater situated in a fossil fueled boiler. These temperatures were obtained from thermocouples welded to the outside of tubes just upstream of the outlet header. Since there is negligible heat flux in this region, this measured temperature is indicative of both metal temperature and steam temperature at the tube outlet. Note that in the center of the superheater, steam temperatures are substantially higher than the design bulk steam temperature of 1005° F., while at either side of the superheater, the steam temperature is substantially below this value.

Clearly, in the example of FIG. 1, the center tubes are running hotter than the outside tubes. If this is typical of the unit operation from the beginning, then the center tubes will have substantially less remaining creep life than the outside tubes. Also, it is pointed out that tube metal temperatures in the furnace section where a heat flux is imposed on the tube will be even higher than the outlet steam temperatures in FIG. 1.

FIG. 2*a* shows the creep damage accumulation rate of a typical boiler tube throughout its life. At an operating time of 200,000 hours, slightly over eighty per cent of the creep life of the tube has been consumed. If the tube continues to operate under the same temperature conditions, it will fail due to creep at approximately 225,000 hours.

FIG. 2*b* expands the upper portion of the curve of FIG. 2*a*. It can be seen that if the temperature of this tube could be lowered at the 200,000 hour point, then its remaining life could be significantly extended. For instance, by lowering the temperature 30° F., the remaining life would be extended from 25,000 to 75,000 hours. Each tube will have its own unique life gain depending on when and how much its temperature is reduced, how fast creep damage is accumulating, how much original life remains, and the wall thinning rate due to fireside erosion. These unique curves illustrate the benefit which can be derived according to the present invention.

SUMMARY OF THE INVENTION

A method of increasing the reliability and remaining useful life of a boiler tube system, whereby the current condition of the tubes is evaluated; the temperature of the tubes during operation of the boiler is obtained and a tube-to-tube outlet temperature profile is developed therefrom; the steam flow redistribution which would be required in the tubes in order to alter the temperature distribution across the tubes is determined; and the tubes are modified in order to achieve the required flow redistribution. The condition of the tubes is ascertained by performing a non-destructive evaluation, such as ultrasonic examination, and calculating the remaining useful life of the tubes. Stress and creep conditions are determined for each tube and a failure point is predicted. Using a model of the system, its characteristics are manipulated to predict a profile which will extend the useful life and reliability of the system. Then the physical system is modified by installing steam flow controllers to redistribute the steam flow and achieve extended life and reliability from the system.

DETAILED DESCRIPTION OF THE INVENTION

Figure 3:
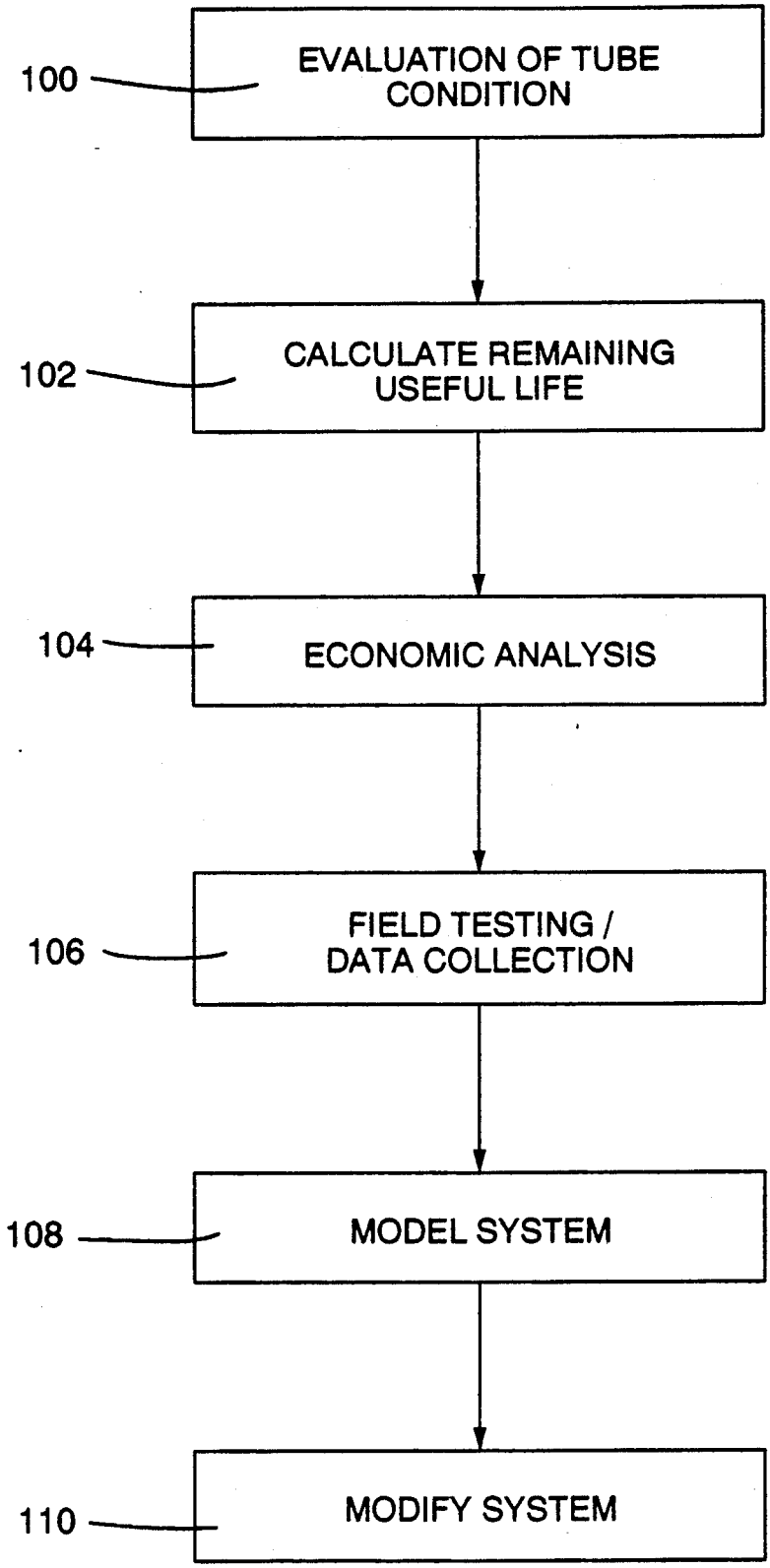
FIG. 3 is a flow chart illustrating the steps of the method of the present invention.

FIG. 3 is a flow chart illustrating the basic procedure for extending the useful life of boiler tubes according to the present invention. It is to be understood that the method of the present invention applies to all types of boiler tubes. Further, the order of the steps is not meant to be limiting, but merely explanatory. The order in which the steps may be performed can change from case to case.

In step 100, the current condition of the superheater is ascertained by examination of the superheater tubes. This entails measuring the wall thickness and steamside oxide scale buildup at numerous points in the system.

In step 102, the remaining useful life of each of the superheater tubes is calculated. This encompasses measuring the creep damage accumulation as a function of steamside oxide scale buildup, operating conditions, oxidation kinetics, tube material properties, and tube wastage rate. Also, time integrated tube metal temperature and stress is calculated.

In step 104, a cost/benefit analysis is made to determine whether the expenditure required to extend tube life is economically justified.

In step 106, field testing of the tubes occurs. This includes collecting inlet and outlet tube leg temperature, bulk steam flowrate and pressure. A temperature profile is then developed. Further, background data is compiled. This includes collecting operating data for the boiler, including number of operating hours, bulk steam outlet temperature and pressure, and steam flowrate at different loads, and design information for the superheater, including tube dimensions (lengths, outside diameter, and wall thickness), tube material, and tube assembly configurations. The operating data is routinely available in plant logs as part of the operating history of the boiler.

In step 108, the tube system is mathematically modeled in order to determine optimum pressure and temperature conditions which would extend the life of the tube system.

In step 110, the tubes are modified to obtain the desired life-extending performance specification.

Figures 4A, 4B:
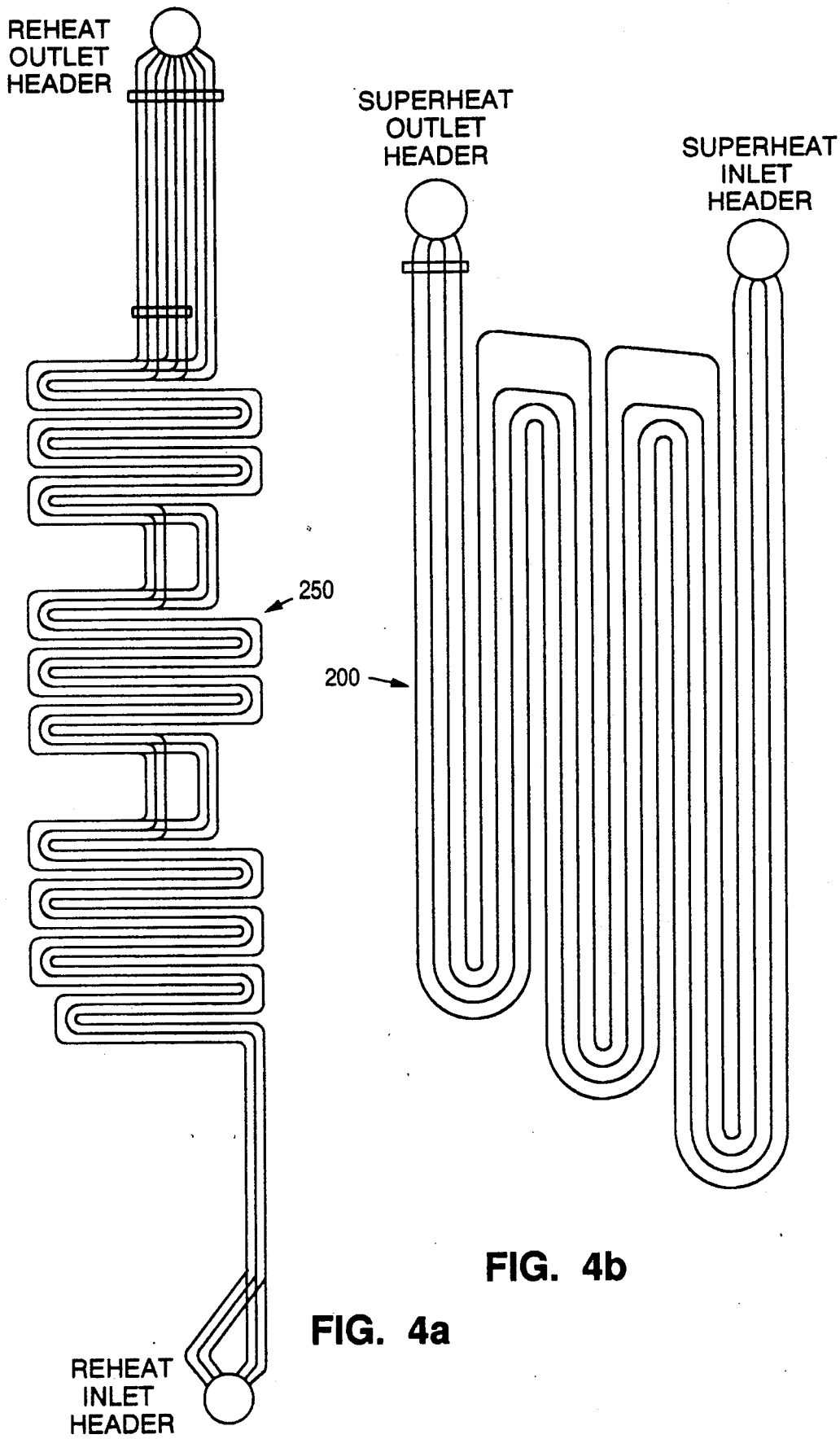
FIGS. 4*a* and 4*b* are schematic elevational views of sections of superheater and reheater tubing.
Figure 5:
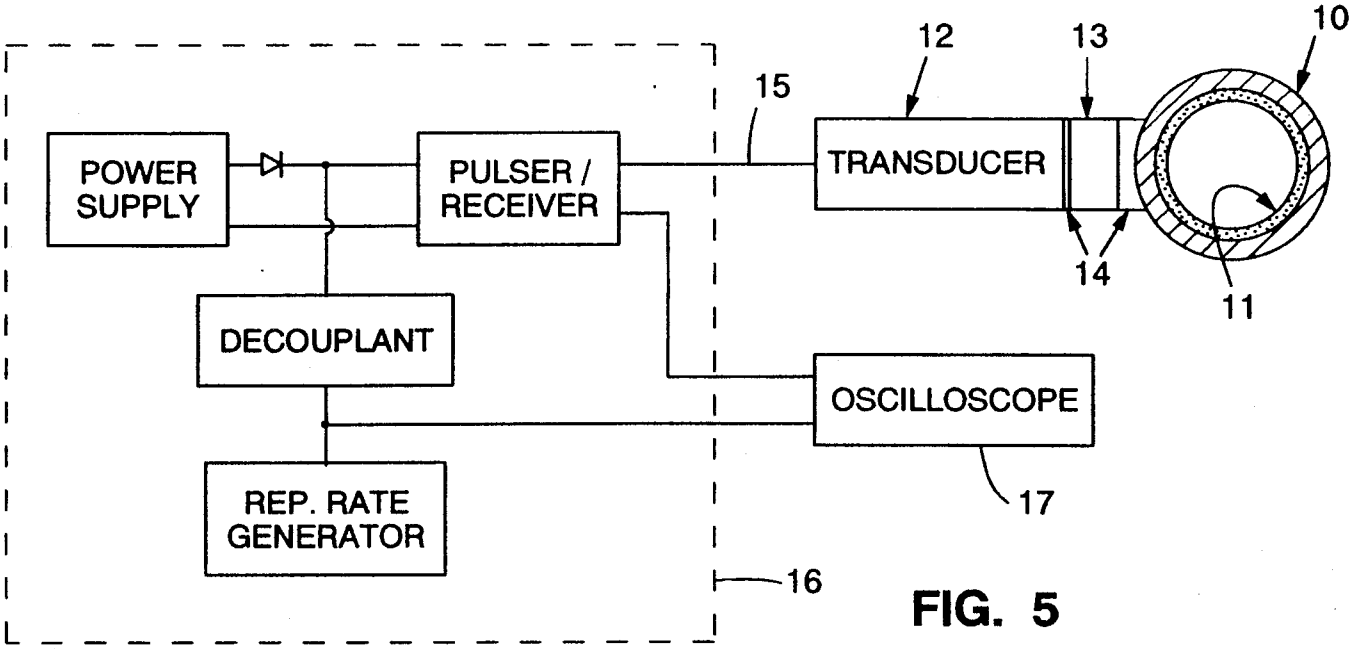
FIG. 5 is a schematic diagram of an arrangement for ultrasonically determining the thickness of oxide scale on the inside surface of a boiler tube in accordance with the present invention.

Referring now to FIG. 4*a* and 4*b*, the present condition of superheater tubes 200 and reheater tubes 250 is evaluated by conducting a field examination of the tubes. One method of evaluation uses a non-destructive examination (NDE), such as the Ultrasonic Shear Wave technique disclosed in pending U.S. Pat. Application No. 07/345,130, filed Apr. 28, 1989, which is incorporated herein by reference. By using this technique, measurements of oxide scale thickness TK and tube wall thickness W2 may be discerned. Tube surfaces may be prepared for examination by sandblasting, or by using a sanding disk on an angle grinder, or similar method. Referring now to FIG. 5, a hand-held contact ultrasonic shear wave transducer 12, such as model V222-BA hand-held shear wave transducer produced by Panametrics of Waltham, Mass., with a replaceable, variable length or fixed length delay line 13, is positioned on the clean, outer surface of a tube 10 with a high viscosity shear wave couplant 14 positioned between the transducer 12 and the delay line 13 and between the delay line 13 and the steel tube 10. The delay line 13 utilizes a delay medium such as quartz or Plexiglas and improves the signal-to-noise ratio for certain combinations of tube and oxide thicknesses. A different length line may be used for different combinations of tube and oxide thicknesses.

Transducer 12 is electrically connected via a coaxial cable 15 to a high-frequency pulse/receiver 16. Receiver 16 is connected to a delayed time pulse overlap oscilloscope 17 having a delayed time base and pulse overlap feature for conveniently and accurately measuring the differential time of flight.

The transducer 12 is a high-frequency shear wave transducer. The transducer operates at 20 MHz and has a circular active element with a diameter of 0.25 inches. Transducer 12 is positioned so that the ultrasonic shear wave beam is directed normal to the inside surface of the tube. An ultrasonic signal is then generated and received by the high frequency pulse/receiver 16. The signal is displayed on the oscilloscope 17.

A first time of flight ($ToF_1$) to and from the tube metal/scale interface and a second time of flight ($ToF_2$) to and from the scale/fluid interface are determined. The difference between the first and second times of flight (ToF) can be correlated via a chart, formula, or table, in order to determine the thickness of the scale.

Since the velocity of sound in scale is not known and will vary in scales of different compositions, the time of flight technique does not produce an absolute or exact scale thickness. However, the time of flight data is related to actual scale thickness measurement established by physical techniques such as metallurgical examination. Ultrasonic and metallurgical results are related by the following equation:

$$TK=(0.069238\times(ToF_2-ToF_1))-1.448038$$

where TK = oxide thickness in mils and ToF is in nanoseconds. An actual scale thickness standard is predetermined by subjecting a plurality of samples of the boiler tubes which include varying thickness of scale to ultrasonic pulses to determine the time of flight within the scale. Thereafter, the scale on the samples is physically measured and a formula or conversion curve relating scale thickness to the time of flight of the pulses in the scale is established. This predetermined standard, i.e., curve or formula, is used in further testing thereby obviating the need for further destructive tests.

It is recommended that in addition to the non-destructive examination, a destructive examination be performed on some tubes by physically removing them from the system and making manual measurements of oxide scale thickness TK and maximum and minimum wall thicknesses W1 and W2, as well as tube outside diameter OD. These tube samples are also subjected to complete chemical and metallographic analyses. The resulting data are used to confirm the much more extensive non-destructive data. The benefits of combining destructive with non-destructive techniques include: a more thorough examination of the tube; material verification; microstructural evaluations; verification of non-destructive oxide scale thickness measurements; and rating of internal oxide scale exfoliation. The major advantage of the non-destructive technique is the ability to examine a greater number of tubes, quickly and cheaply. This increases the confidence that all critical areas are examined. A combination of the two techniques provides the most effective means of characterizing a superheater or reheater section.

The remaining useful life of each tube may then be calculated. In this analysis, an average stress value SA is derived in a series of calculations based on the measured internal scale thickness TK, the maximum wall thickness W1, the minimum wall thickness W2, the steam pressure PR, and the specified outside diameter of the tube OD, as follows:

$$SA=(OS+CS)/2 \quad (1)$$

$$SA = (OS + CS)/2 \quad (1)$$

$$\text{where } OS = \frac{(OD/2)^2 + ((OD/2) - W1)^2}{(OD/2)^2 - ((OD/2) - W1)^2} \times PR \quad (2)$$

$$\text{and } CS = \frac{((OD/2) + W2 - W1)^2 + ((OD/2) - W1)^2}{((OD/2) + W2 - W1)^2 - ((OD/2) - W1)^2} \times PR \quad (3)$$

The effects of time and temperature are combined into a single parameter, termed the Larson-Miller parameter LMP, as follows:

$$LMP=R\times(C+\log(HR)) \quad (4)$$

where R = tube metal temperature in degrees Rankine, HR = operating hours and C is a constant. The value of the LMP is estimated for each examined tube section by the following relationship between LMP and the measured internal scale thickness TK:

$$LMP=(A\times\log(TK))+E \quad (5)$$

where A is constant and E is a material constant.

A projected creep condition is then derived for incremental time periods based on hoop stress and the Larson-Miller parameter, assuming linear oxide growth and linear wall thinning rates. The creep condition is quantified by the average stress SA and the LMP.

Each time the projected creep condition is incremented, it is compared to the failure conditions for the tube material used. Tube rupture is predicted when the failure condition is reached.

The scale thickness at failure TF is calculated from equation (5) rearranged as:

$$TF=10^{((LMP-E)/A)} \quad (6)$$

The remaining useful life RUL is calculated on the basis of linear oxide growth as:

$$RUL=CH\times((TF/TK)-1) \quad (7)$$

where CH = current operating hours.

Based on the remaining useful life calculation, an economic analysis can be made to determine whether it would be economically beneficial to extend the life of the current system of boiler tubes. Considerations include the changes and impact on the operation of the unit, implementation costs of the modifications, fuel costs, and forced outage costs.

Figure 1:
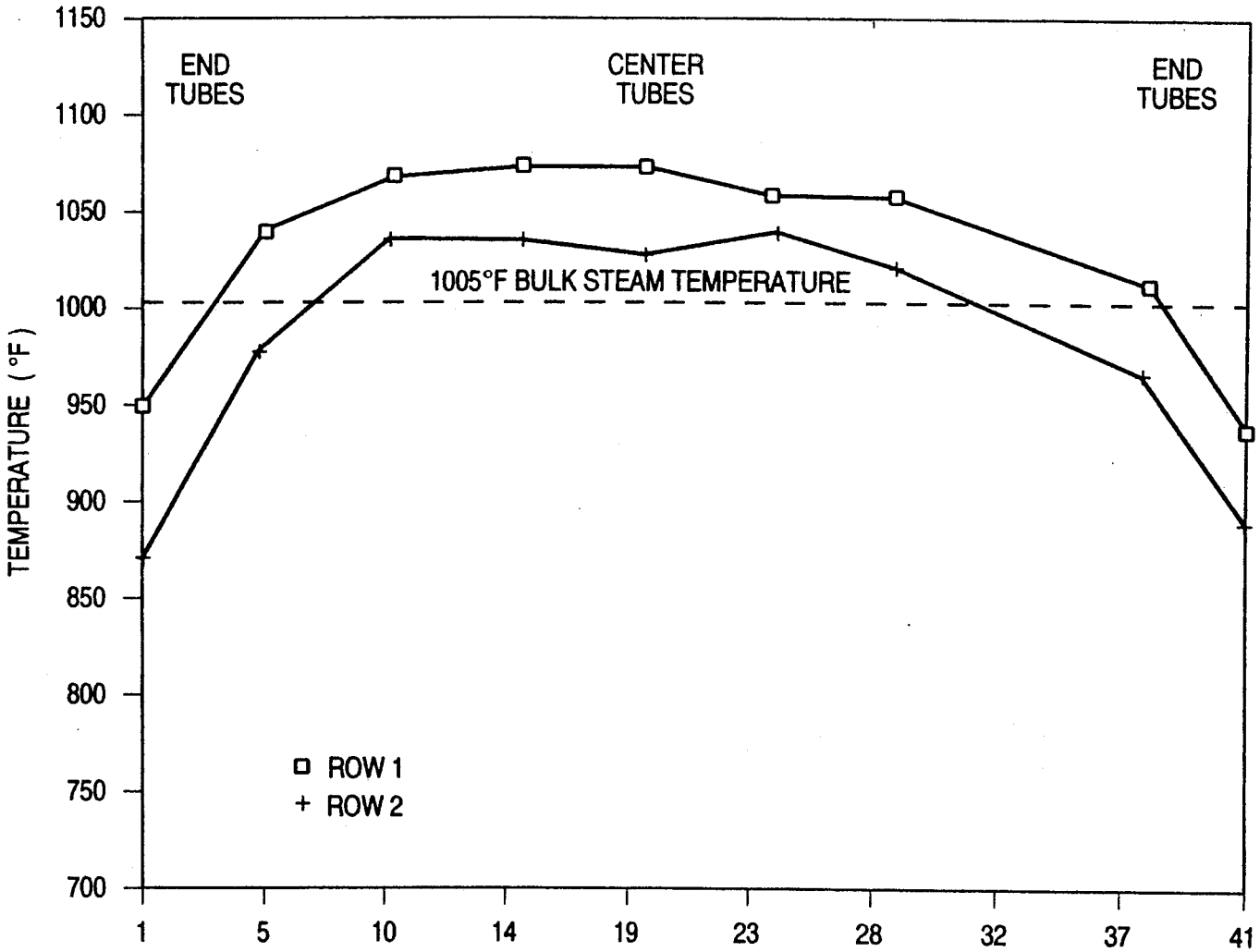
FIG. 1 is a graph illustrating the steam temperature profile across superheater outlet legs.
Figure 2A:
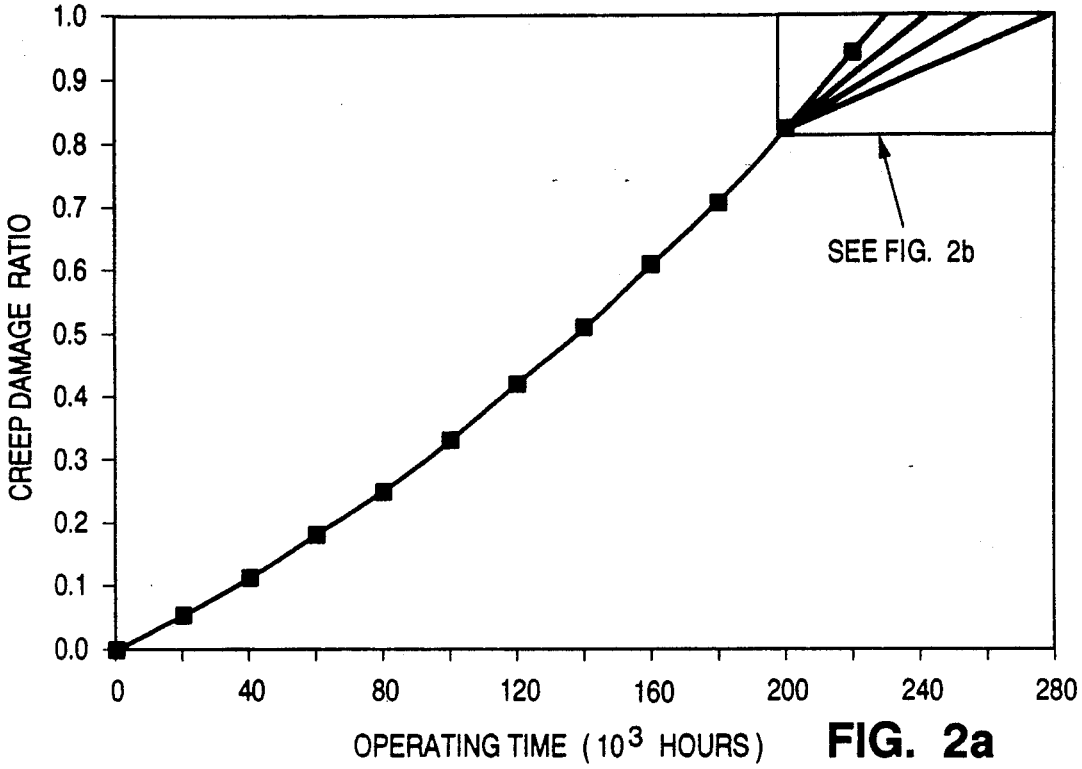
FIGS. 2*a* and 2*b* are graphs illustrating creep damage accumulation versus remaining life of typical superheater tubes.
Figure 2B:
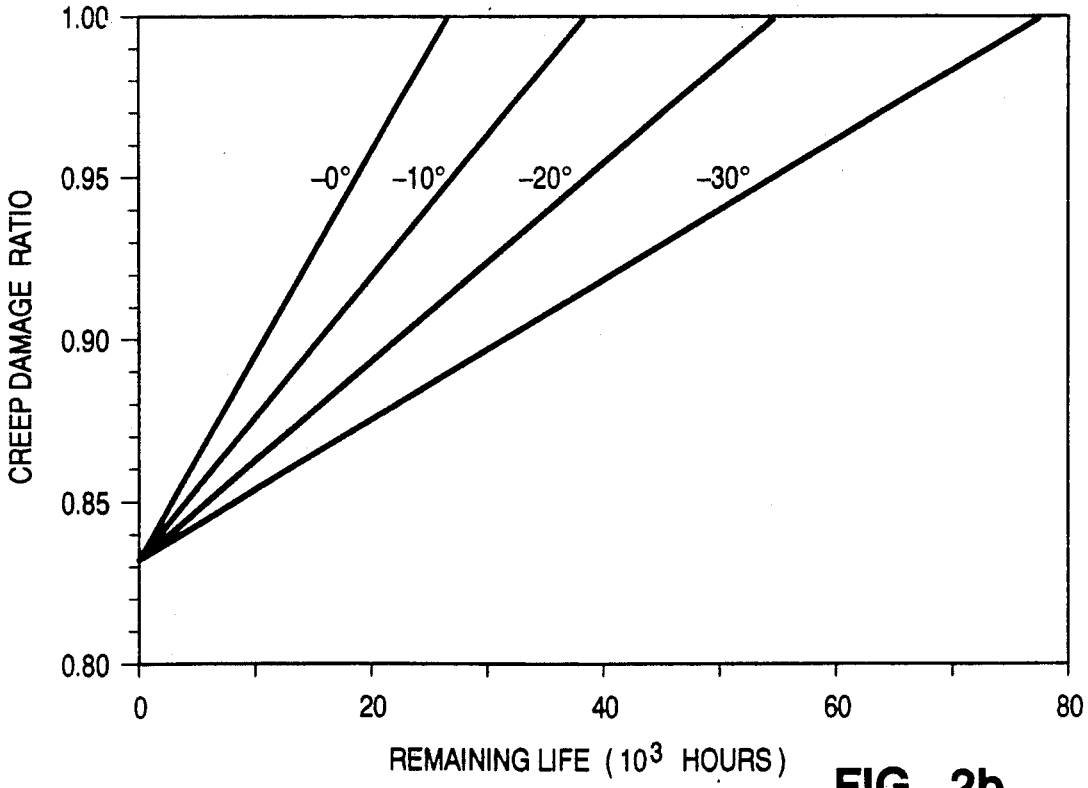

Next, a thermodynamic profile of the tubes is developed for various load conditions. The inlet and outlet temperatures may be measured utilizing existing thermocouples and by placing additional thermocouples, as needed, at the same location on several elements of the tubing and plotting the readings. It is economically impractical to put thermocouples on each tube, so a pattern is established to obtain representative temperature data by instrumenting typically 5% to 20% of the tubes. This pattern is dictated by the degree of nonuniformity exhibited by the oxide scale thickness profiles. Most of the thermocouples are installed on tube outlet legs, with less than a dozen installed on inlet legs. Pressure and flow rates at both the inlet and outlet are also obtained. The resultant temperature profiles will indicate the tubes carrying the hottest steam in the section. One example is illustrated in FIG. 1, where it can be seen that the temperature is cooler at the outside tubes, increasing almost 150° at the middle tubes.

Using the thermodynamic information, the arrangement of the tube sections is mathematically modeled. The inlet and outlet conditions of each tube are measured or estimated. The tube circuit geometry is modeled based on the design drawings. Using the geometry and inlet and outlet conditions, the heat flux for each tube circuit is calculated based on an estimate of the enthalpy increase through the circuit and the surface area of the tubing.

Steam thermodynamic and fluid transport properties may be determined by readily available means given the basic operating parameters, such as temperature and pressure. Basic engineering equations are used to determine the estimated pressure, the steam temperature, and the steam to scale interface temperature. The estimated pressure is a function of the length of the tube segment and the internal diameter of the tube segment. Thus, the use of thermodynamic and heat transfer equations allows the calculation of steam temperature at any location along the tube.

Next, temperatures at the tube midwall and the metal to scale interface are calculated at each tube material change location, based on the temperature of the steam to scale interface temperature and the following equation:

$$DT = Q/A \times RO(\ln(RI/RS)/Ks + \ln(RC/RI)/Km) \quad (8)$$

where

DT = delta temperature

Q/A = heat flux

RO, RI, RS, RC = radius: outside, inside, scale, mid-wall

Ks, Km = scale and metal conductivities

The invention described here has the additional flexibility to accommodate changes in boiler operation. The life expended for each tube in the system up to the point in time when redesign occurs depends upon past boiler fireside conditions. The redesign incorporating steam flow redistribution permits these fireside conditions to be changed for future boiler operation. Any changes in fireside conditions for future operation are quantified with the tube outlet leg thermocouple data that are collected in the field testing of the tubes, as described in step 106 of FIG. 3. The remaining useful life of each tube is thus a function of the tube life already expended under past fireside conditions and the future tube life consumption rate under future fireside conditions.

Next, the remaining creep life at each tube material change from inlet to outlet is calculated for every tube in the superheater. The calculation is based on changing hoop stress, changing metal temperature, and time of exposure. The changing tube conditions are taken into account by dividing the exposure time into small time increments and recalculating the temperature and stress for each increment. The accumulated creep damage is then summed up for each increment.

The change in hoop stress is calculated as a function of constant internal pressure and diminishing tube wall thickness. The change in metal temperature with respect to time is calculated from heat flow equation (8), which takes into account the increasing steamside scale thickness in the presence of a constant heat flux through the tube wall and across the internal scale.

The relationship between temperature and oxide scale thickness was derived from isothermal tests and can be expressed in the form:

$$\text{scale thickness} = f(\text{time, temperature}).$$

By eliminating time as an independent variable, this relationship can be rewritten in the form:

$$\text{scale growth rate} = f(\text{scale thickness, temperature}).$$

Thus, the scale growth rate is independent of the time/-temperature history that grew the scale and may be used with varying temperatures. The general equation which describes the relationship between temperature, scale thickness, and operating hours is:

$$TK = exp\,(((C \times R/B) + D) \times HR^{(R/B)}) \quad (9)$$

where HR = hours exposure and R = metal temperature in degrees Rankine and where B, C, and D are variables selected for each application to achieve a "best fit" of the data. Field experience has shown that the value of C may be taken as 30.6 ($13.3 \times \ln(10)$). Thus, only two data points are required to define the equation. One data point consists of the average of measured scale thickness, the bulk steam temperature, and the operating hours. The other data point may be approximated as TK = 0.005 inches, R = 1050° R, and HR = 10,000 hours.

The initial tube metal temperature is set equal to the steam to scale interface temperature calculated above. Then, the values for time, metal temperature, scale temperature, stress, and scale thickness are increased using the heat transfer equation (8) and the scale thickness kinetic equation (9).

Creep damage of each time increment is expressed by the following equation:

$$DR = TI/FH \quad (10)$$

where DR is the creep damage ratio, TI is the time increment in hours, and FH is the hours projected to failure at the given stress and temperature. The overall creep damage is accumulated as the sum of the damage ratios of the individual time increments. Creep rupture is predicted when the damage ratio equals one.

Minimum and mean creep rupture material properties are based on data published in the ASTM Creep Rupture Data Series. An acceptable failure probability must be selected. A normal distribution about the mean in the ASTM failure curves is assumed, and the minimum failure line corresponds to a 5 percent probability of failure.

Once the distribution of remaining creep life is computed, those regions of the superheater with the shortest and longest remaining lives can be determined. This provides input for determining steam flow redistribution. That input consists of a set of desired temperature changes, whereby the tube outlet leg temperature for the hot tubes are reduced and those for the cold tubes are increased.

Next, the steam flow distribution is modeled for the entire superheater. A one-time input is the complete matrix of tube dimensions, including all lengths, outer diameters, and wall thicknesses. An iterative input is the desired change in tube outlet steam temperature as specified in the previous step. The model redistributes the tube-to-tube steam flow, while maintaining total steam flow constant, in order to achieve the desired changes in each tube outlet temperature. The model solves the conservation of mass, momentum, and energy equations for steam flow in all tubes simultaneously, yielding the following equation:

$$l_{ki0}\left(\frac{1}{D_{ki0}^{4.8}} - \frac{1}{D_{ki1}^{4.8}}\right) = \left[\left(\frac{\Delta P_0}{\Delta P}\right)\left(\frac{T_{ki20} - T_{ki1}}{T_{ki2} - T_{ki1}}\right)^{1.8} - 1\right] \sum_{j=1}^{J_{ki}} \frac{L_{kij}}{D_{kij}^{4.8}} \quad (11)$$

where the subscripts are defined as:

k = kth tube element i = ith tube row in element k (from the leading edge)

j = jth segment of the ith row, element k and the superscripts are:

K = total number of elements $I_k$ = total number of rows in kth element $J_{ki}$ = total number of segments in the ith row, kth element and the variables are:

$\Delta P$ = pressure drop (in psi) through the tubes before modification $\Delta P_0$ = pressure drop (in psi) through the tubes after modification $D_{ki0}$ = inside diameter (in feet) of the steam flow controller $D_{kij}$ = inside diameter (in feet) of the jth segment in the ith row, kth element $l_{ki0}$ = length of tubing (in feet) of the steam flow controller $L_{kij}$ = length of each tube segment (in feet) with inside diameter $D_{kij}$ $T_{ki1}$ = inlet temperature (°F.) of the ith row, kth element $T_{ki2}$ = outlet temperature (°F.) of the ith row, kth element, before modification $T_{ki20}$ = outlet temperature (°F.) of the ith row, kth element, after modification The steam flow is then redistributed by inserting steam flow controllers (SFC's) of specified length and inner diameter in selected tubes. Usually, these SFC's consist of short portions of tube approximately one foot long with reduced inside diameters. Another critical parameter output of the model is the magnitude of the slight increase in pressure drop across the superheater due to the presence of the SFC's.

$$\frac{\Delta P_0}{\Delta P} = \left\{ \frac{\sum_{k=1}^{K} \sum_{i=1}^{I_k} \left[ \sum_{j=1}^{J_{ki}} \frac{L_{kij}}{D_{kij}^{4.8}} \right]^{-\left(\frac{1}{1.8}\right)}}{\sum_{k=1}^{K} \sum_{i=1}^{I_k} \left[ \left( \frac{l_{ki0}}{D_{ki0}^{4.8}} - \frac{l_{ki0}}{D_{ki1}^{4.8}} \right) + \sum_{j=1}^{J_{ki}} \frac{L_{kij}}{D_{kij}^{4.8}} \right]^{-\left(\frac{1}{1.8}\right)}} \right\}^{1.8} \quad (12)$$

Figure 6:
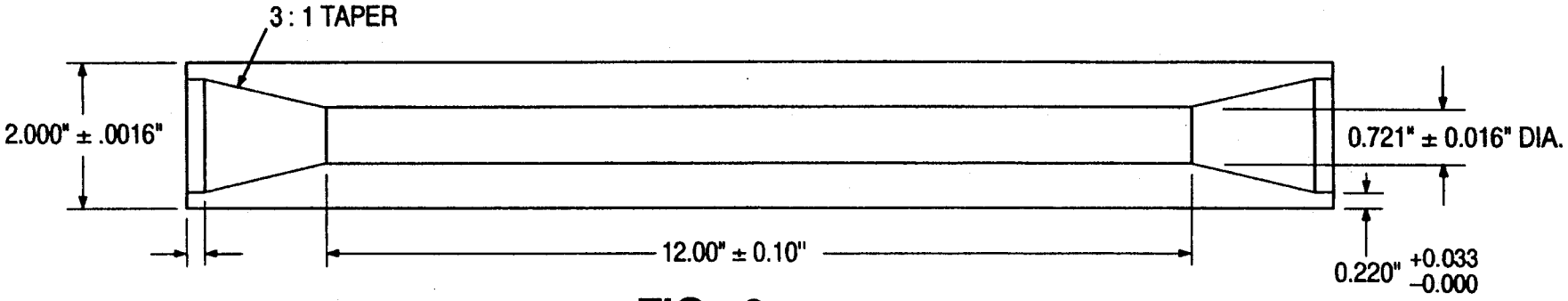
FIG. 6 is a plan diagram of a steam flow controller.
Figure 7A:
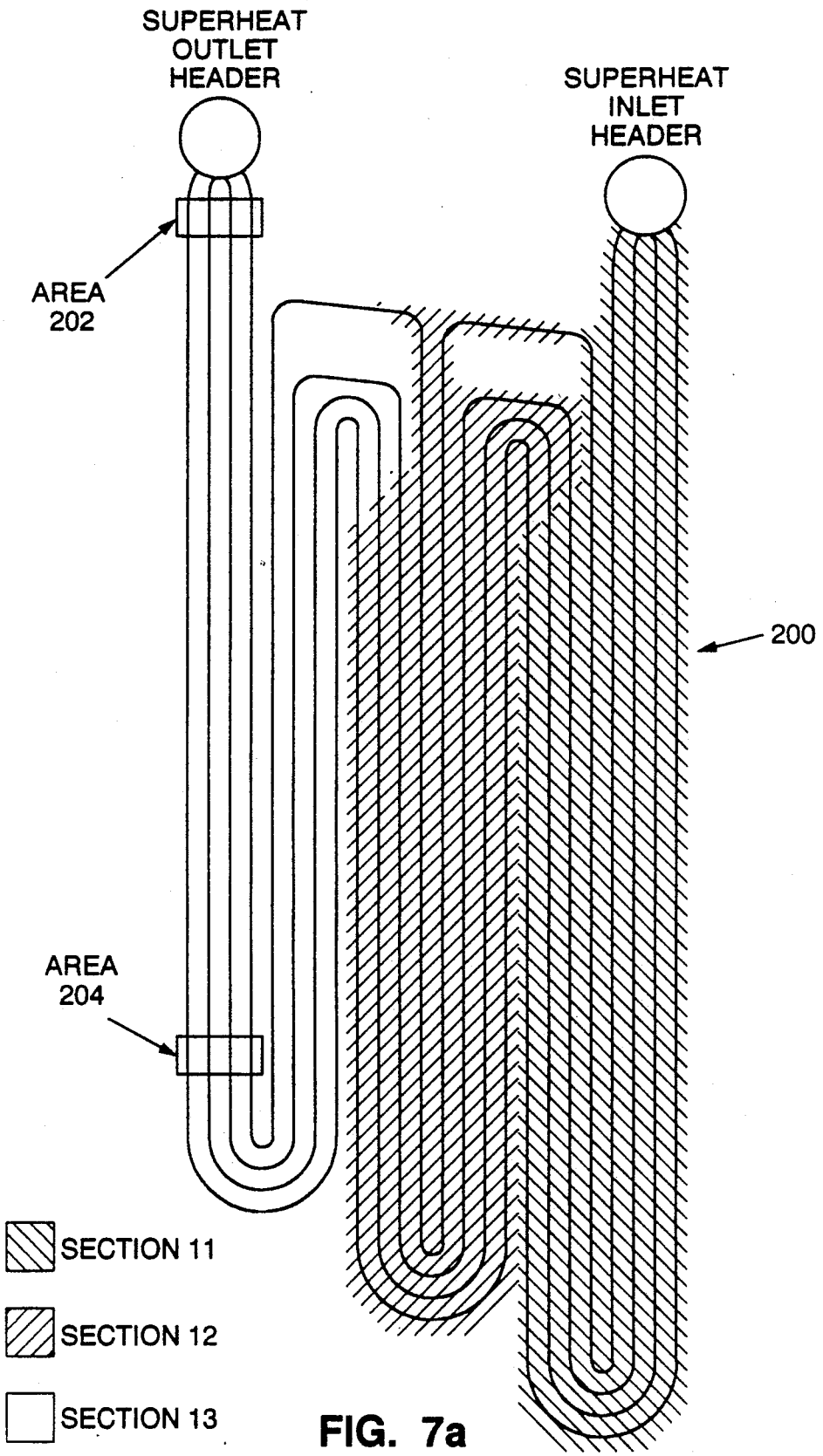
FIG. 7*a* is a schematic elevational view of sections of superheater tubing.
Figure 7B:
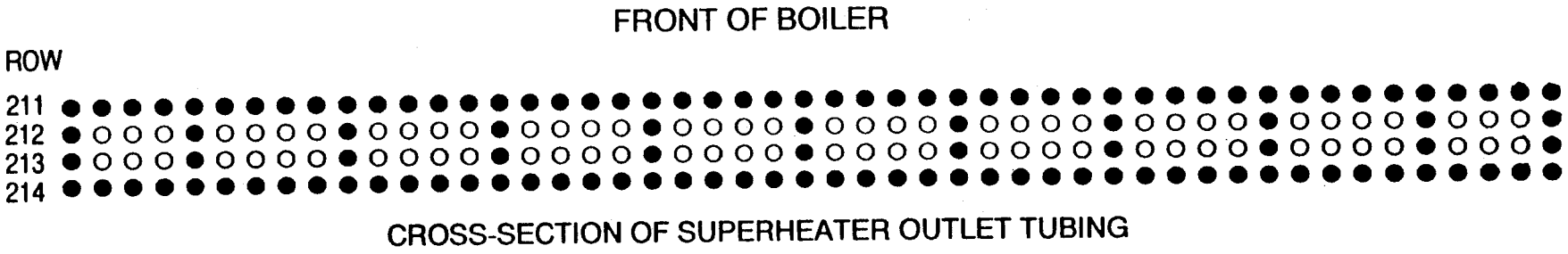
FIG. 7*b* is a cross sectional view of the tubes of FIG. 7*a* showing the locations where nondestructive testing is performed according to the present invention.
Figure 8A:
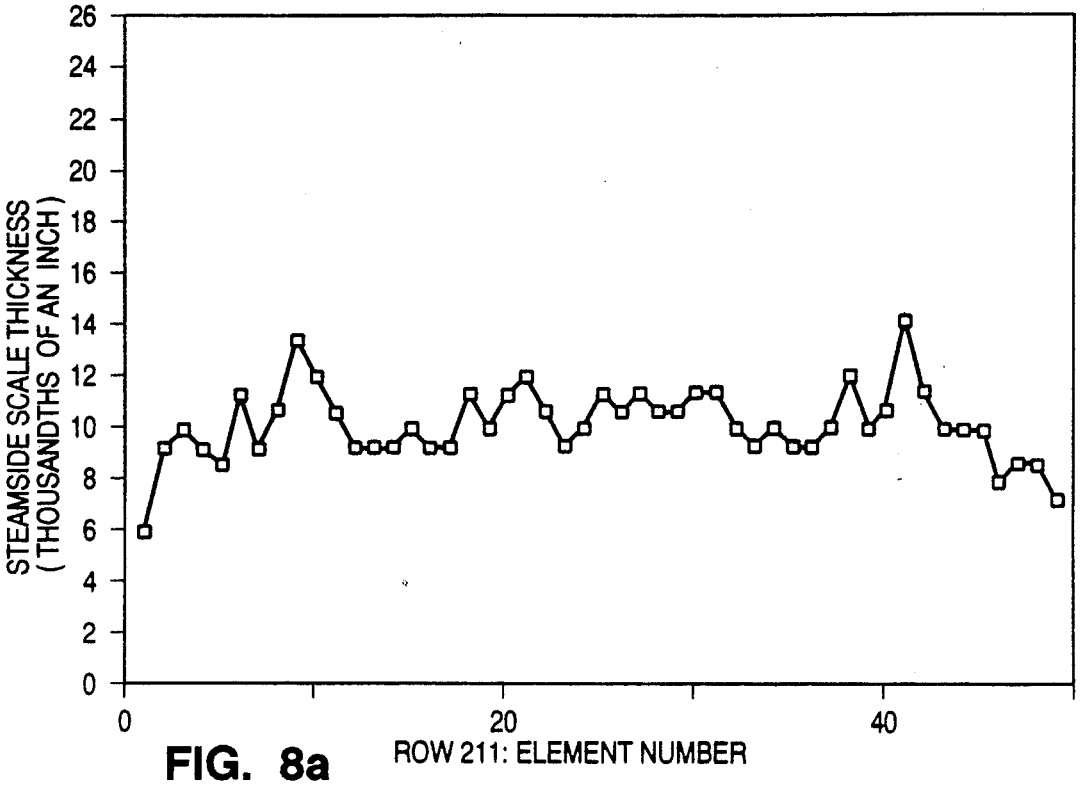
FIGS. 8*a* through 8*d* are graphs illustrating oxide scale measurements on superheater tubing in accordance with the present invention.
Figure 8B:
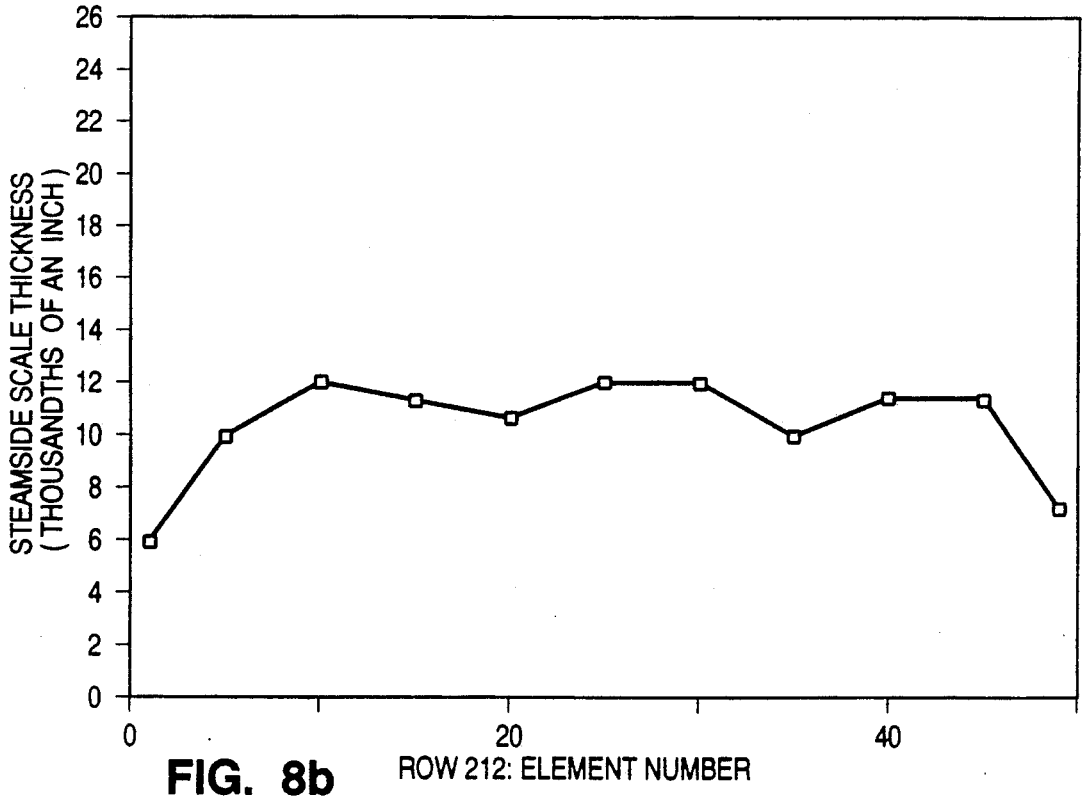
Figure 8C:
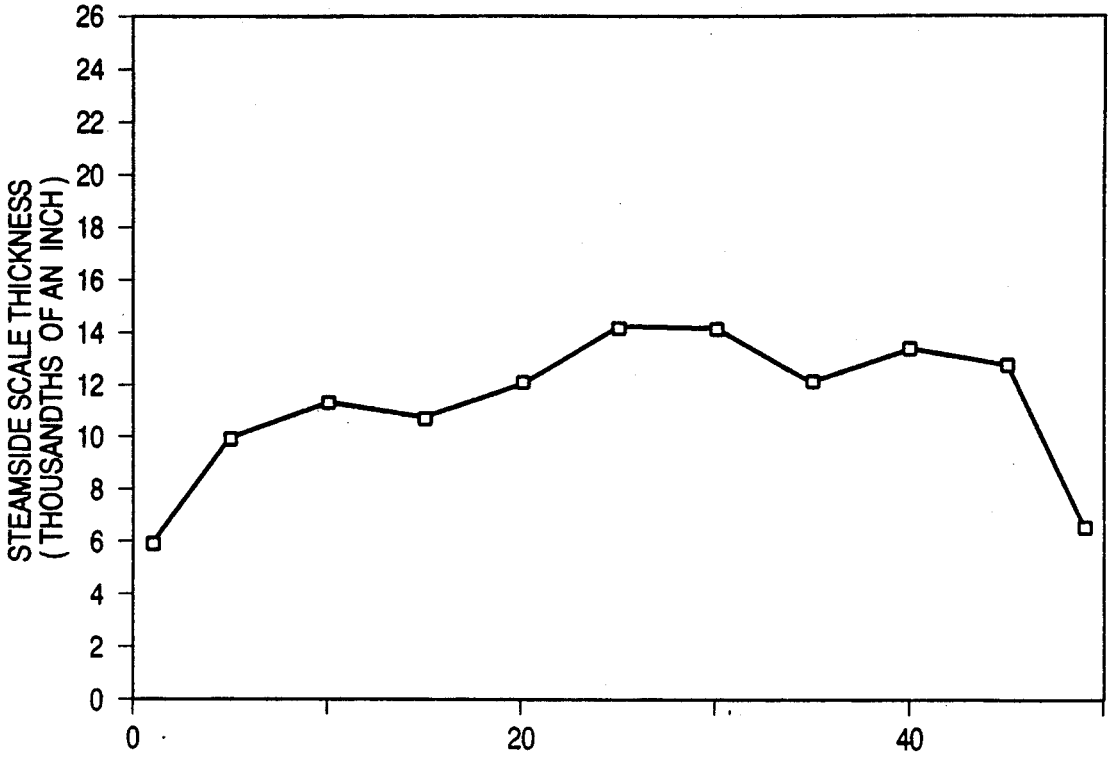
Figure 8D:
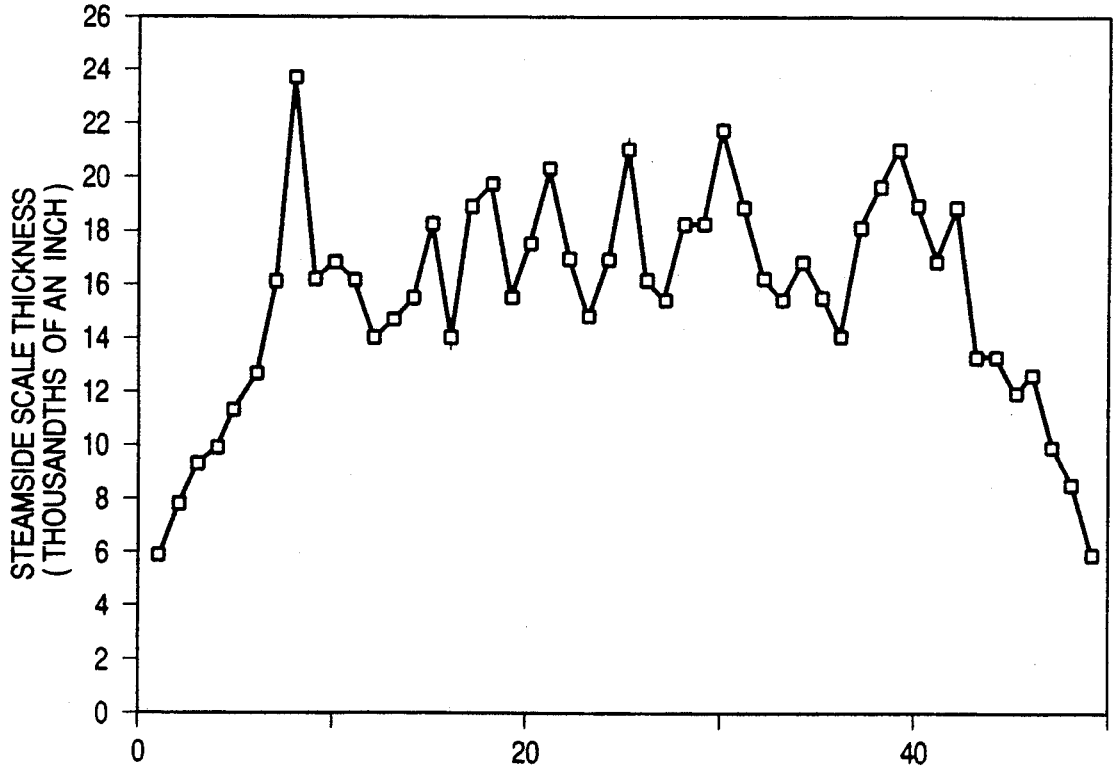

FIG. 6 illustrates a typical SFC design. The SFC is made as long as practical (e.g., approximately one foot so that the diameter restriction can be minimized). A three-to-one taper is used at the entrance and exit to comply with ASME codes and to minimize flow separation and the formation of eddies, as well as eliminate any propensity for plugging. This SFC design is essentially a tube dutchman that is installed with two circumferential welds in the place of a removed tube section. This design does not have the drawbacks of a sharp edged orifice design, such as steam erosion of the orifice inner diameter with subsequent change in flow characteristics, a tendency to cause buildup of deposits upstream and downstream of the orifice, and possibly pluggage.

Some tubes may have virtually no remaining useful life and thus must be replaced. This may occur due to wall thinning or high temperatures.

It should be noted that the design procedure just described can be applied either to existing superheaters or new replacement superheaters. In either case, superheater life can be extended through the application of steam flow redistribution because there will always be heat transfer nonuniformities on the fireside.

One example of the application of the life extension technique according to the present invention will now be discussed.

Referring to FIG. *7a*, sections of high temperature superheater tubing 200 from a boiler system (not shown) having 201,802 hours of operation are illustrated. Table 1 shows the original design specifications for each section, including outside tube diameter OD, specified minimum wall thickness SW, and tube material MA.

TABLE 1

SUPERHEATER TUBING DIMENSIONS

| Section | Outside Diameter (in) | Wall Thickness (in) | Material |
|---|---|---|---|
| 11 | 2.0 | .220 | T11 |
| 12 | 2.0 | .300 | T11 |
| 13 | 2.0 | .380 | T22 |

A total of 130 NDE measurements are taken on the superheater 200. Of these, 120 are recorded on the outlet header tube legs at area 202. Tubes 211 and 214 are examined on every element and tubes 212 and 213 are examined on every fifth element, as illustrated in FIG. *7b*. Ten measurements are taken in the furnace section at area 204 across selected elements of tube 4. The results are compiled in table 2.

TABLE 2

SUPERHEATER AREA 202

Operating Conditions:

| | | | | | | | |
|---|---|---|---|---|---|---|---|
| | | Pressure | | | 1925 psi | | |
| | | Operating Time | | | 201802 hours | | |
| | | Outside Diameter | | | 2.00 inch | | |
| Element | Row | Material (T#) | Specified Wall Thickness (inch) | Measured Wall Thickness (inch) | Steamside Scale Thickness (inch) | Average Stress (psi) | Remain. Useful Life (hours) |
| 1 | 1 | 22 | 0.380 | 0.442 | 0.0060 | 3830 | >200000 |
| 2 | 1 | 22 | 0.380 | 0.421 | 0.0093 | 3888 | >200000 |
| 3 | 1 | 22 | 0.380 | 0.419 | 0.0100 | 3894 | >200000 |
| 4 | 1 | 22 | 0.380 | 0.432 | 0.0093 | 3857 | >200000 |
| 5 | 1 | 22 | 0.380 | 0.426 | 0.0086 | 3874 | >200000 |
| 6 | 1 | 22 | 0.380 | 0.413 | 0.0113 | 3912 | >200000 |
| 7 | 1 | 22 | 0.380 | 0.432 | 0.0093 | 3857 | >200000 |
| 8 | 1 | 22 | 0.380 | 0.421 | 0.0106 | 3888 | >200000 |
| 9 | 1 | 22 | 0.380 | 0.408 | 0.0134 | 3928 | >200000 |
| 10 | 1 | 22 | 0.380 | 0.407 | 0.0120 | 3931 | >200000 |
| 11 | 1 | 22 | 0.380 | 0.426 | 0.0106 | 3874 | >200000 |
| 12 | 1 | 22 | 0.380 | 0.429 | 0.0093 | 3865 | >200000 |
| 13 | 1 | 22 | 0.380 | 0.415 | 0.0093 | 3906 | >200000 |
| 14 | 1 | 22 | 0.380 | 0.423 | 0.0093 | 3882 | >200000 |
| 15 | 1 | 22 | 0.380 | 0.428 | 0.0100 | 3868 | >200000 |
| 16 | 1 | 22 | 0.380 | 0.431 | 0.0093 | 3860 | >200000 |
| 17 | 1 | 22 | 0.380 | 0.421 | 0.0093 | 3888 | >200000 |
| 18 | 1 | 22 | 0.380 | 0.418 | 0.0113 | 3897 | >200000 |
| 19 | 1 | 22 | 0.380 | 0.438 | 0.0100 | 3840 | >200000 |
| 20 | 1 | 22 | 0.380 | 0.418 | 0.0113 | 3897 | >200000 |
| 21 | 1 | 22 | 0.380 | 0.416 | 0.0120 | 3903 | >200000 |

TABLE 2-continued

| SUPERHEATER AREA 202 | | | | | | | |
|---|---|---|---|---|---|---|---|
| 22 | 1 | 22 | 0.380 | 0.409 | 0.0106 | 3925 | >200000 |
| 23 | 1 | 22 | 0.380 | 0.433 | 0.0093 | 3854 | >200000 |
| 24 | 1 | 22 | 0.380 | 0.423 | 0.0100 | 3882 | >200000 |
| 25 | 1 | 22 | 0.380 | 0.430 | 0.0113 | 3862 | >200000 |
| 26 | 1 | 22 | 0.380 | 0.415 | 0.0106 | 3906 | >200000 |
| 27 | 1 | 22 | 0.380 | 0.415 | 0.0113 | 3906 | >200000 |
| 28 | 1 | 22 | 0.380 | 0.425 | 0.0106 | 3877 | >200000 |
| 29 | 1 | 22 | 0.380 | 0.400 | 0.0106 | 3953 | >200000 |
| 30 | 1 | 22 | 0.380 | 0.424 | 0.0113 | 3879 | >200000 |
| 31 | 1 | 22 | 0.380 | 0.423 | 0.0113 | 3882 | >200000 |
| 32 | 1 | 22 | 0.380 | 0.419 | 0.0100 | 3894 | >200000 |
| 33 | 1 | 22 | 0.380 | 0.422 | 0.0093 | 3885 | >200000 |
| 34 | 1 | 22 | 0.380 | 0.429 | 0.0100 | 3865 | >200000 |
| 35 | 1 | 22 | 0.380 | 0.418 | 0.0093 | 3897 | >200000 |
| 36 | 1 | 22 | 0.380 | 0.419 | 0.0093 | 3894 | >200000 |
| 37 | 1 | 22 | 0.380 | 0.418 | 0.0100 | 3897 | >200000 |
| 38 | 1 | 22 | 0.380 | 0.408 | 0.0120 | 3928 | >200000 |
| 39 | 1 | 22 | 0.380 | 0.443 | 0.0100 | 3827 | >20000 |
| 40 | 1 | 22 | 0.380 | 0.401 | 0.0106 | 3950 | >200000 |
| 41 | 1 | 22 | 0.380 | 0.397 | 0.0141 | 3963 | >200000 |
| 42 | 1 | 22 | 0.380 | 0.427 | 0.0113 | 3871 | >200000 |
| 43 | 1 | 22 | 0.380 | 0.424 | 0.0100 | 3879 | >200000 |
| 44 | 1 | 22 | 0.380 | 0.416 | 0.0100 | 3903 | >200000 |
| 45 | 1 | 22 | 0.380 | 0.408 | 0.0100 | 3928 | >200000 |
| 46 | 1 | 22 | 0.380 | 0.434 | 0.0079 | 3851 | >200000 |
| 47 | 1 | 22 | 0.380 | 0.429 | 0.0086 | 3865 | >200000 |
| 48 | 1 | 22 | 0.380 | 0.418 | 0.0086 | 3897 | >200000 |
| 49 | 1 | 22 | 0.380 | 0.433 | 0.0072 | 3854 | >200000 |
| 1 | 2 | 22 | 0.380 | 0.427 | 0.0060 | 3871 | >200000 |
| 5 | 2 | 22 | 0.380 | 0.427 | 0.0100 | 3871 | >200000 |
| 10 | 2 | 22 | 0.380 | 0.423 | 0.0120 | 3882 | >200000 |
| 15 | 2 | 22 | 0.380 | 0.422 | 0.0113 | 3885 | >200000 |
| 20 | 2 | 22 | 0.380 | 0.412 | 0.0106 | 3915 | >200000 |
| 25 | 2 | 22 | 0.380 | 0.414 | 0.0120 | 3909 | >200000 |
| 30 | 2 | 22 | 0.380 | 0.421 | 0.0120 | 3888 | >200000 |
| 35 | 2 | 22 | 0.380 | 0.426 | 0.0100 | 3874 | >200000 |
| 40 | 2 | 22 | 0.380 | 0.414 | 0.0113 | 3909 | >200000 |
| 45 | 2 | 22 | 0.380 | 0.422 | 0.0113 | 3885 | >200000 |
| 49 | 2 | 22 | 0.380 | 0.422 | 0.0072 | 3885 | >200000 |
| 1 | 3 | 22 | 0.380 | 0.438 | 0.0060 | 3840 | >200000 |
| 5 | 3 | 22 | 0.380 | 0.431 | 0.0100 | 3860 | >200000 |
| 10 | 3 | 22 | 0.380 | 0.418 | 0.0113 | 3897 | >200000 |
| 15 | 3 | 22 | 0.380 | 0.429 | 0.0106 | 3865 | >200000 |
| 20 | 3 | 22 | 0.380 | 0.423 | 0.0120 | 3882 | >200000 |
| 25 | 3 | 22 | 0.380 | 0.418 | 0.0141 | 3897 | >200000 |
| 30 | 3 | 22 | 0.380 | 0.412 | 0.0141 | 3915 | >200000 |
| 35 | 3 | 22 | 0.380 | 0.417 | 0.0120 | 3900 | >200000 |
| 40 | 3 | 22 | 0.380 | 0.403 | 0.0134 | 3944 | >200000 |
| 45 | 3 | 22 | 0.380 | 0.415 | 0.0127 | 3906 | >200000 |
| 49 | 3 | 22 | 0.380 | 0.400 | 0.0065 | 3953 | >200000 |
| 1 | 4 | 22 | 0.380 | 0.433 | 0.0060 | 3854 | >200000 |
| 2 | 4 | 22 | 0.380 | 0.435 | 0.0079 | 3848 | >200000 |
| 3 | 4 | 22 | 0.380 | 0.416 | 0.0093 | 3903 | >200000 |
| 4 | 4 | 22 | 0.380 | 0.432 | 0.0100 | 3857 | >200000 |
| 5 | 4 | 22 | 0.380 | 0.408 | 0.0113 | 3928 | >200000 |
| 6 | 4 | 22 | 0.380 | 0.426 | 0.0127 | 3874 | >200000 |
| 7 | 4 | 22 | 0.380 | 0.428 | 0.0161 | 3868 | >200000 |
| 8 | 4 | 22 | 0.380 | 0.407 | 0.0237 | 3931 | 85200 |
| 9 | 4 | 22 | 0.380 | 0.414 | 0.0161 | 3909 | >200000 |
| 10 | 4 | 22 | 0.380 | 0.413 | 0.0168 | 3912 | >200000 |
| 11 | 4 | 22 | 0.380 | 0.423 | 0.0161 | 3882 | >200000 |
| 12 | 4 | 22 | 0.380 | 0.414 | 0.0141 | 3909 | >200000 |
| 13 | 4 | 22 | 0.380 | 0.416 | 0.0148 | 3903 | >200000 |
| 14 | 4 | 22 | 0.380 | 0.419 | 0.0155 | 3894 | >200000 |
| 15 | 4 | 22 | 0.380 | 0.386 | 0.0182 | 4001 | 149100 |
| 16 | 4 | 22 | 0.380 | 0.418 | 0.0141 | 3897 | >200000 |
| 17 | 4 | 22 | 0.380 | 0.396 | 0.0189 | 3967 | 146300 |
| 18 | 4 | 22 | 0.380 | 0.404 | 0.0196 | 3940 | 141400 |
| 19 | 4 | 22 | 0.380 | 0.421 | 0.0155 | 3888 | >200000 |
| 20 | 4 | 22 | 0.380 | 0.416 | 0.0175 | 3903 | 193200 |
| 21 | 4 | 22 | 0.380 | 0.400 | 0.0203 | 3953 | 127000 |
| 22 | 4 | 22 | 0.380 | 0.419 | 0.0168 | 3894 | >200000 |
| 23 | 4 | 22 | 0.380 | 0.416 | 0.0148 | 3903 | >200000 |
| 24 | 4 | 22 | 0.380 | 0.412 | 0.0168 | 3915 | >200000 |
| 25 | 4 | 22 | 0.380 | 0.409 | 0.0210 | 3925 | 123300 |
| 26 | 4 | 22 | 0.380 | 0.405 | 0.0161 | 3936 | >200000 |
| 27 | 4 | 22 | 0.380 | 0.405 | 0.0155 | 3937 | >200000 |
| 28 | 4 | 22 | 0.380 | 0.376 | 0.0182 | 4037 | 139500 |
| 29 | 4 | 22 | 0.380 | 0.403 | 0.0182 | 3944 | 165400 |
| 30 | 4 | 22 | 0.380 | 0.410 | 0.0216 | 3921 | 113900 |
| 31 | 4 | 22 | 0.380 | 0.397 | 0.0189 | 3963 | 147200 |

TABLE 2-continued

| SUPERHEATER AREA 202 | | | | | | | |
|---|---|---|---|---|---|---|---|
| 32 | 4 | 22 | 0.380 | 0.421 | 0.0161 | 3888 | >200000 |
| 33 | 4 | 22 | 0.380 | 0.395 | 0.0155 | 3970 | >200000 |
| 34 | 4 | 22 | 0.380 | 0.407 | 0.0168 | 3931 | 198900 |
| 35 | 4 | 22 | 0.380 | 0.397 | 0.0155 | 3963 | >200000 |
| 36 | 4 | 22 | 0.380 | 0.398 | 0.0141 | 3960 | >200000 |
| 37 | 4 | 22 | 0.380 | 0.399 | 0.0182 | 3957 | 161500 |
| 38 | 4 | 22 | 0.380 | 0.393 | 0.0196 | 3977 | 132200 |
| 39 | 4 | 22 | 0.380 | 0.393 | 0.0210 | 3977 | 111700 |
| 40 | 4 | 22 | 0.380 | 0.421 | 0.0189 | 3888 | 169000 |
| 41 | 4 | 22 | 0.380 | 0.415 | 0.0168 | 3906 | >200000 |
| 42 | 4 | 22 | 0.380 | 0.403 | 0.0189 | 3944 | 152500 |
| 43 | 4 | 22 | 0.380 | 0.411 | 0.0134 | 3918 | >200000 |
| 44 | 4 | 22 | 0.380 | 0.424 | 0.0134 | 3879 | >200000 |
| 45 | 4 | 22 | 0.380 | 0.406 | 0.0120 | 3934 | >200000 |
| 46 | 4 | 22 | 0.380 | 0.407 | 0.0127 | 3931 | >200000 |
| 47 | 4 | 22 | 0.380 | 0.403 | 0.0100 | 3944 | >200000 |
| 48 | 4 | 22 | 0.380 | 0.416 | 0.0086 | 3903 | >200000 |
| 49 | 4 | 22 | 0.380 | 0.427 | 0.0060 | 3871 | >200000 |
| 21 | 4 | 22 | 0.380 | 0.365 | 0.0265 | 4079 | 36700 |
| 25 | 4 | 22 | 0.380 | 0.375 | 0.0292 | 4041 | 19900 |
| 26 | 4 | 22 | 0.380 | 0.361 | 0.0230 | 4095 | 65700 |
| 29 | 4 | 22 | 0.380 | 0.369 | 0.0244 | 4064 | 56700 |
| 30 | 4 | 22 | 0.380 | 0.372 | 0.0278 | 4052 | 29000 |
| 31 | 4 | 22 | 0.380 | 0.363 | 0.0278 | 4087 | 25100 |
| 37 | 4 | 22 | 0.380 | 0.341 | 0.0244 | 4182 | 42000 |
| 38 | 4 | 22 | 0.380 | 0.327 | 0.0272 | 4248 | 15000 |
| 39 | 4 | 22 | 0.380 | 0.373 | 0.0258 | 4048 | 46200 |
| 40 | 4 | 22 | 0.380 | 0.357 | 0.0251 | 4112 | 44300 |

Review of this data indicates that wall thinning has occurred in area 204. The current remaining life in area 204 is shown to range from 15,000 hours to 66,000 hours. The current remaining life for all tubing in area 202 exceeds 85,000 hours.

FIGS. 8*a* through 8*d* shown the measured oxide scale thickness for rows 211 through 214 in area 202. These figures also show the temperature profile, since thicker oxide scale correlates to higher effective tube metal temperatures. In that regard, it is seen that there is a temperature variation across the rows, with row 214 having the hottest tubes.

Figure 9:
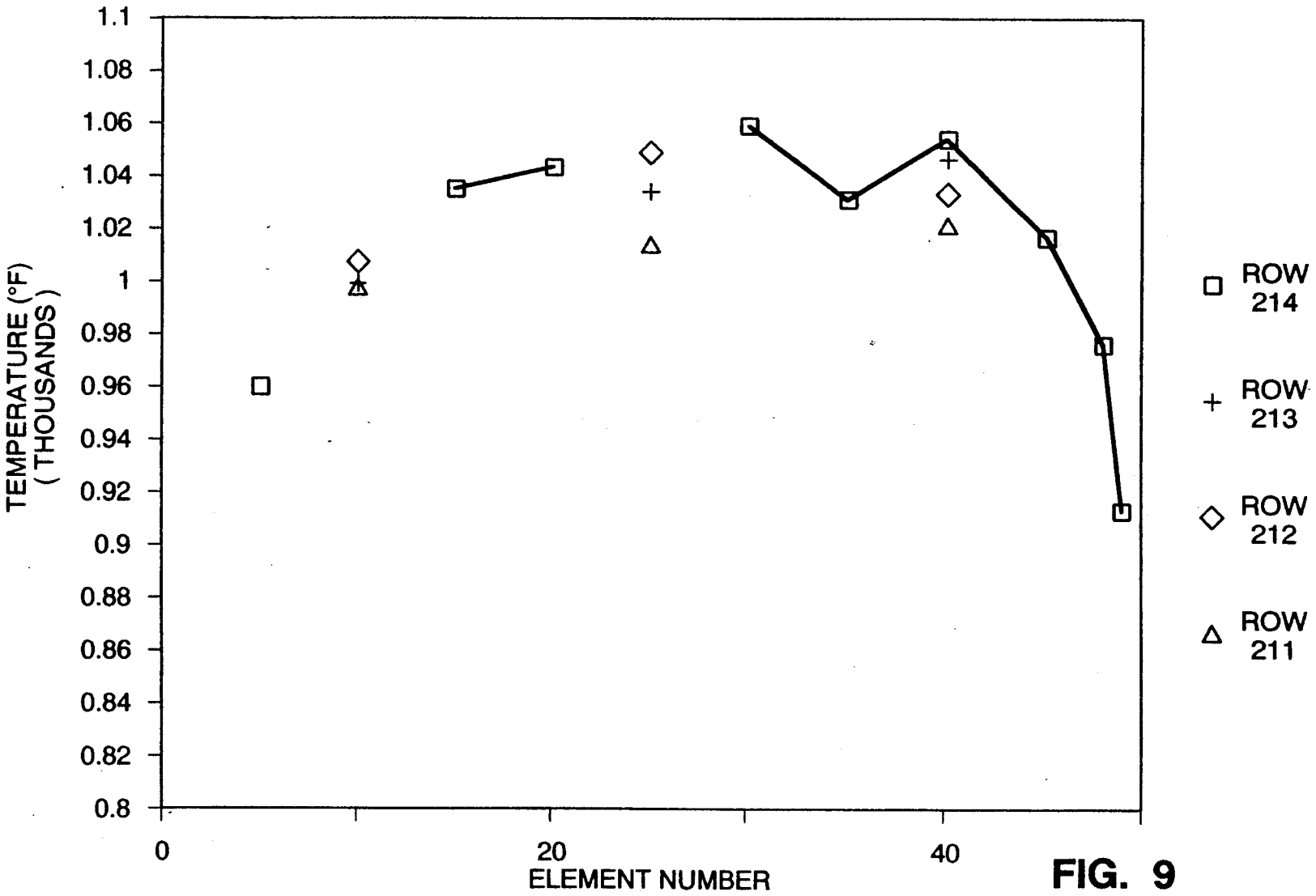
FIG. 9 is a graph illustrating outlet temperature measurements on superheater tubing in accordance with the present invention.

Next, performance tests provide thermodynamic information for five different steady state load cases. The parameters of interest, measured directly or derived from other parameters, are inlet pressure, outlet pressure, mass flow rate, inlet temperature, and outlet temperature. Table 4 shows these parameters (except for outlet temperature). FIG. 9 shows graphically the outlet temperature for the superheater for one load case (100 MW).

TABLE 4

SUPERHEATER PERFORMANCE TEST PARAMETERS

| Load (MW) | Inlet Pressure (psig) | Outlet Pressure (psig) | Mass Flow Rate (lbm/hr) | Average Inlet Temperature (F.) |
|---|---|---|---|---|
| 40 | — | 1216.1 | 260,077 | 688.95 |
| 55 | 1220.9 | 1202.2 | 354,551 | 683.15 |
| 70 | 1524.3 | 1512.2 | 436,020 | 701.95 |
| 100 | 1816.9 | 1807.7 | 629,510 | 718.75 |
| 161 | 1899.0 | 1812.3 | 1,087,776 | 740.65 |

Finally, the system is modeled using all the collected data, and a new temperature profile is developed which will result in an extended remaining life of the boiler tube system. The physical realization of the new temperature profile is accomplished by installing SFC's and replacement tubing in various locations.

Figure 10:
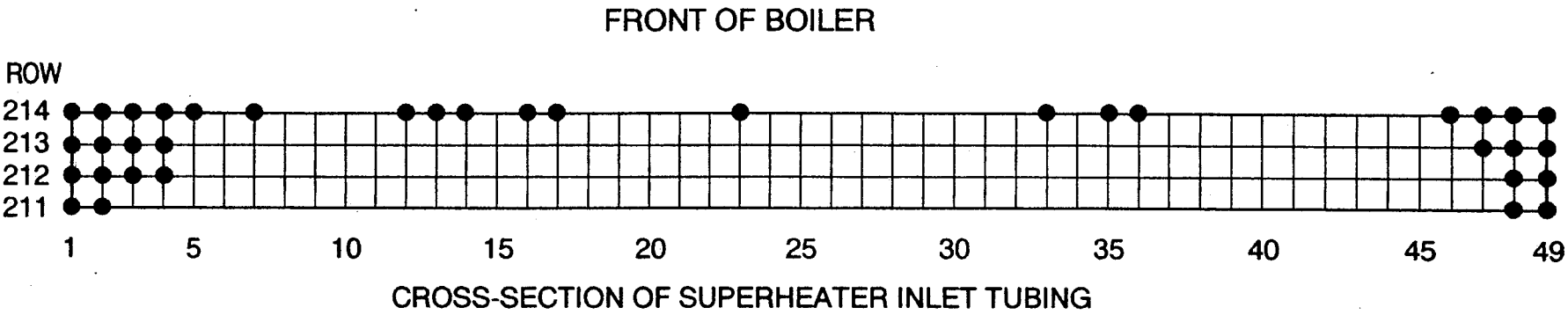
FIG. 10 is a cross-sectional diagram of the inlet of a superheater showing placement of steam flow controllers in accordance with the present invention.

For example, 36 SFC's are installed at the inlet header of the superheater 200 according to the pattern illustrated in FIG. 10. To reduce costs and minimize installation concerns, a single size of SFC is chosen. Each SFC has a 2-inch outside diameter, a 0.639-inch thick wall, and is 16 inches long. The material is ASME SA-213-T11. The SFC's are installed in the tubing at the stub weld near the inlet header. A minimum 3:1 taper of the inside diameter should be utilized.

Figure 11:
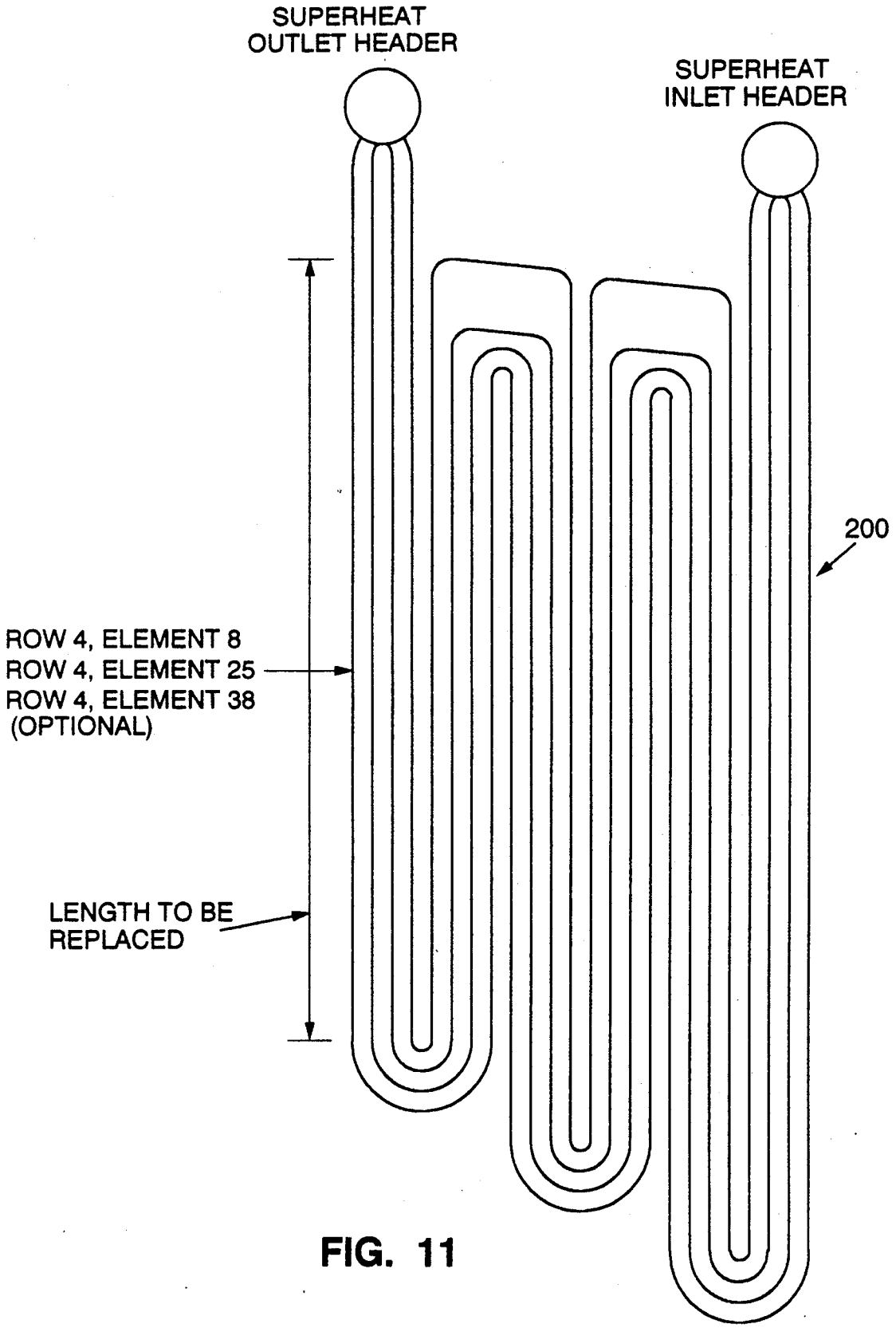
FIG. 11 is a schematic elevational view of sections of superheater tubing showing tubes to be replaced in accordance with the present invention.
Figure 12A:
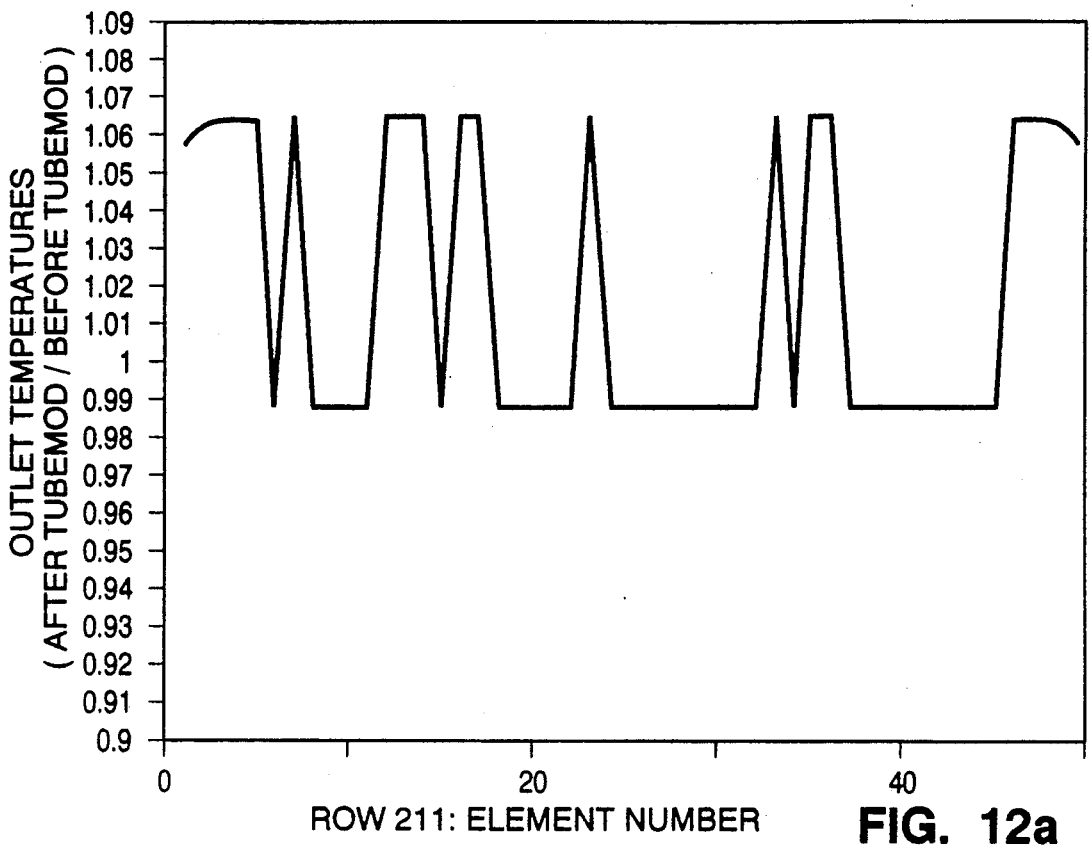
FIGS. 12*a* through 12*d* are graphs illustrating tube steam temperature ratios before and after modification in accordance with the present invention.
Figure 12B:
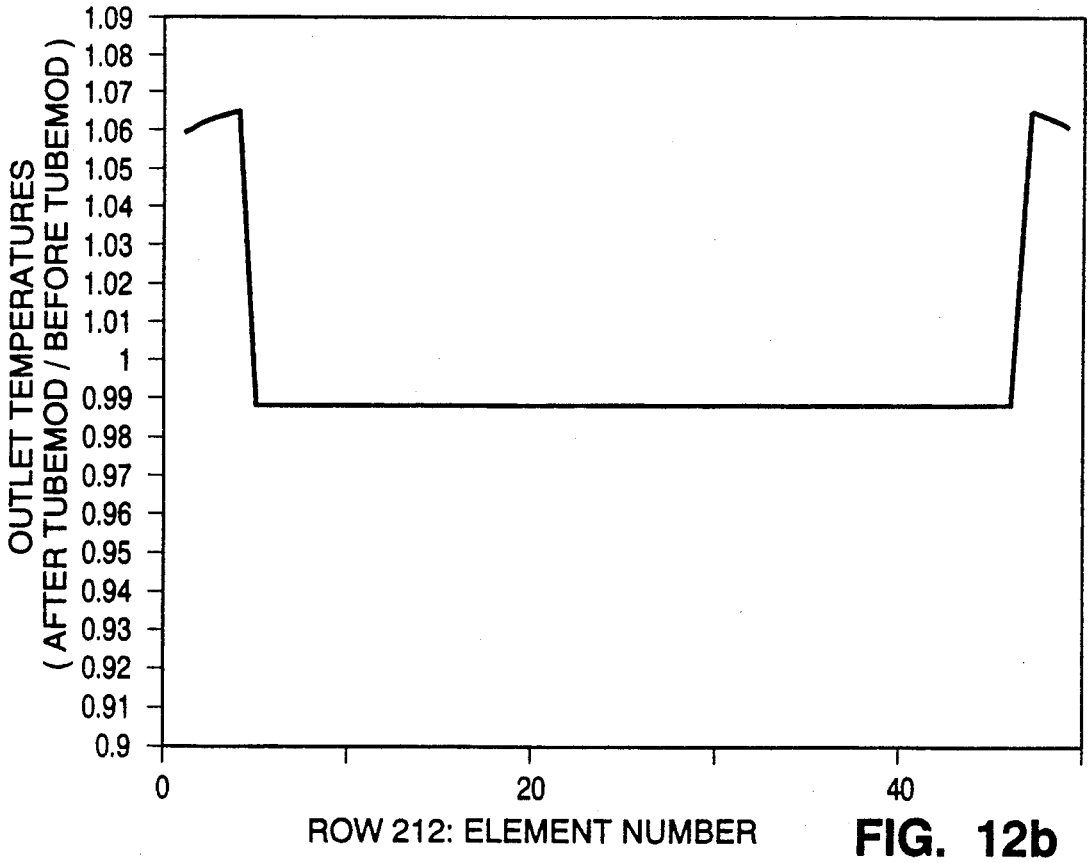
Figure 12C:
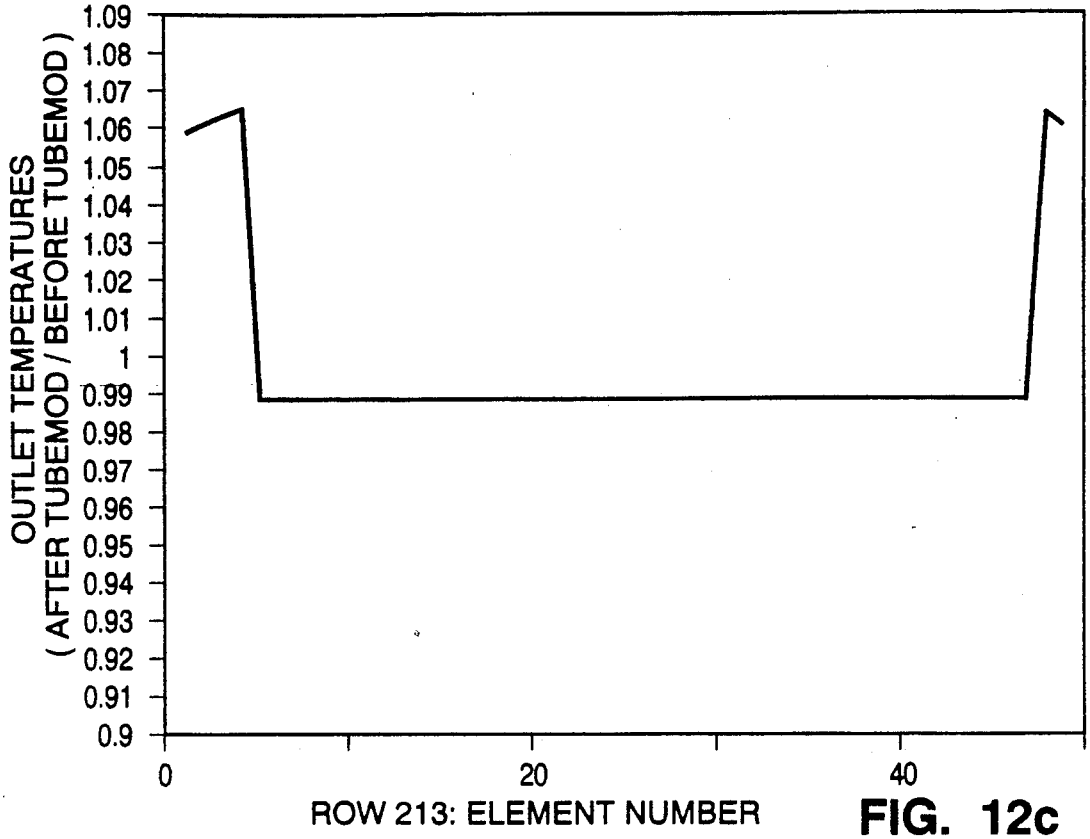
Figure 12D:
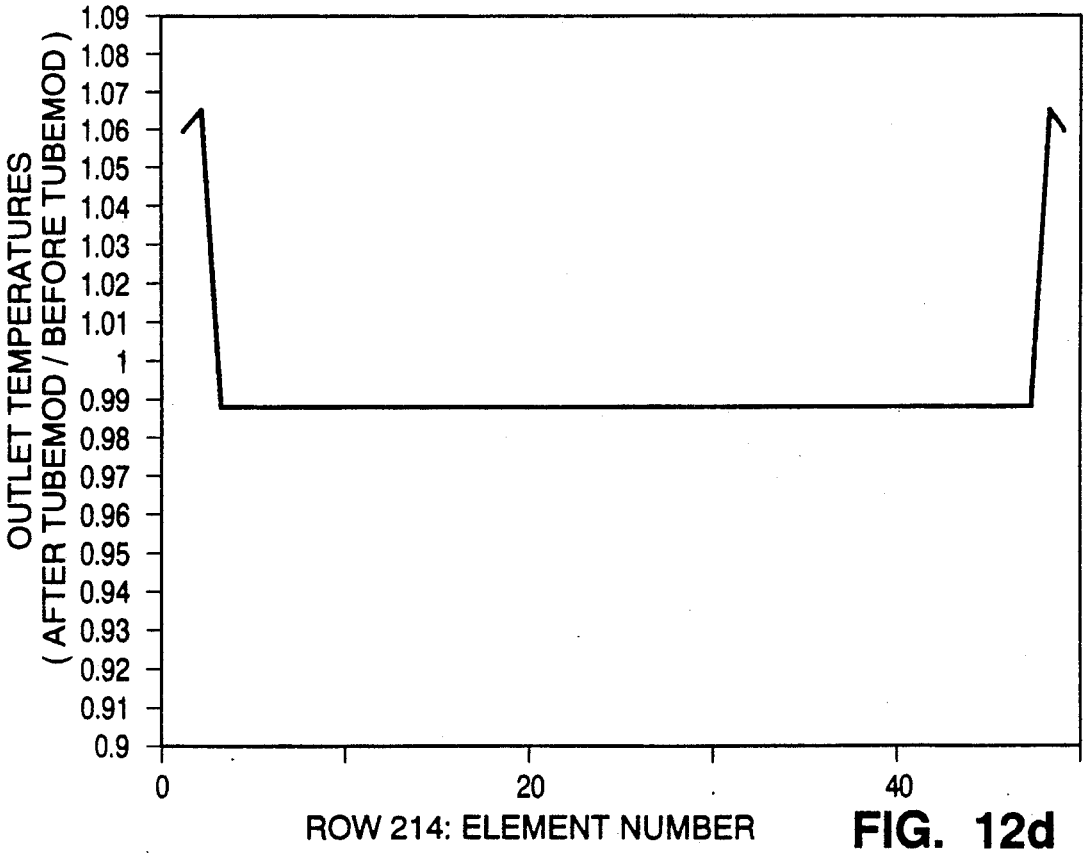
Figure 13A:
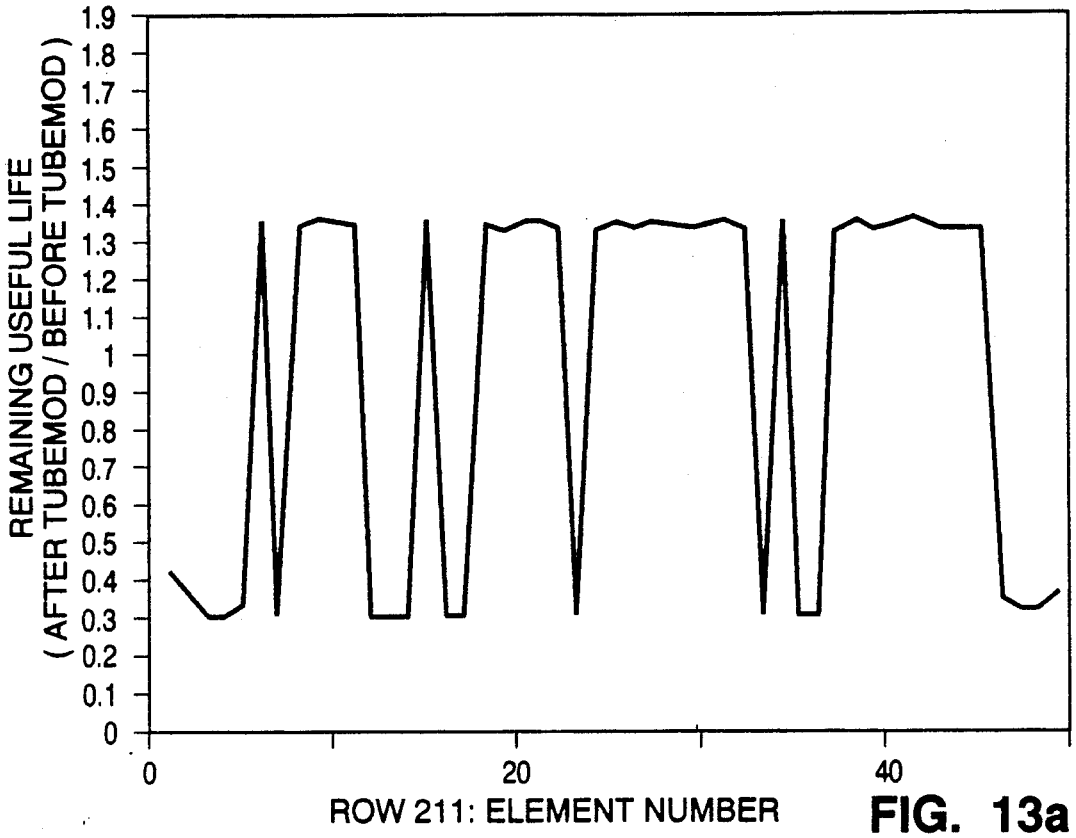
FIGS. 13*a* through 13*d* are graphs illustrating tube remaining life ratios before and after modification in accordance with the present invention.
Figure 13B:
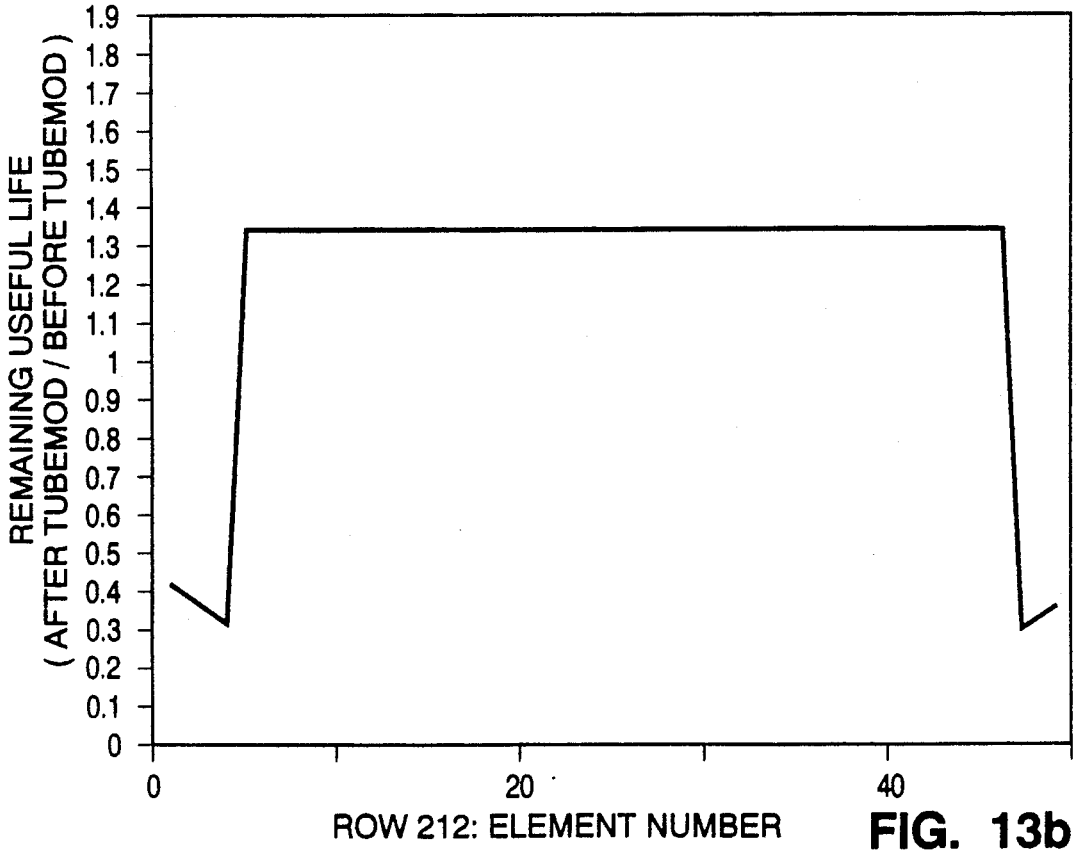
Figure 13C:
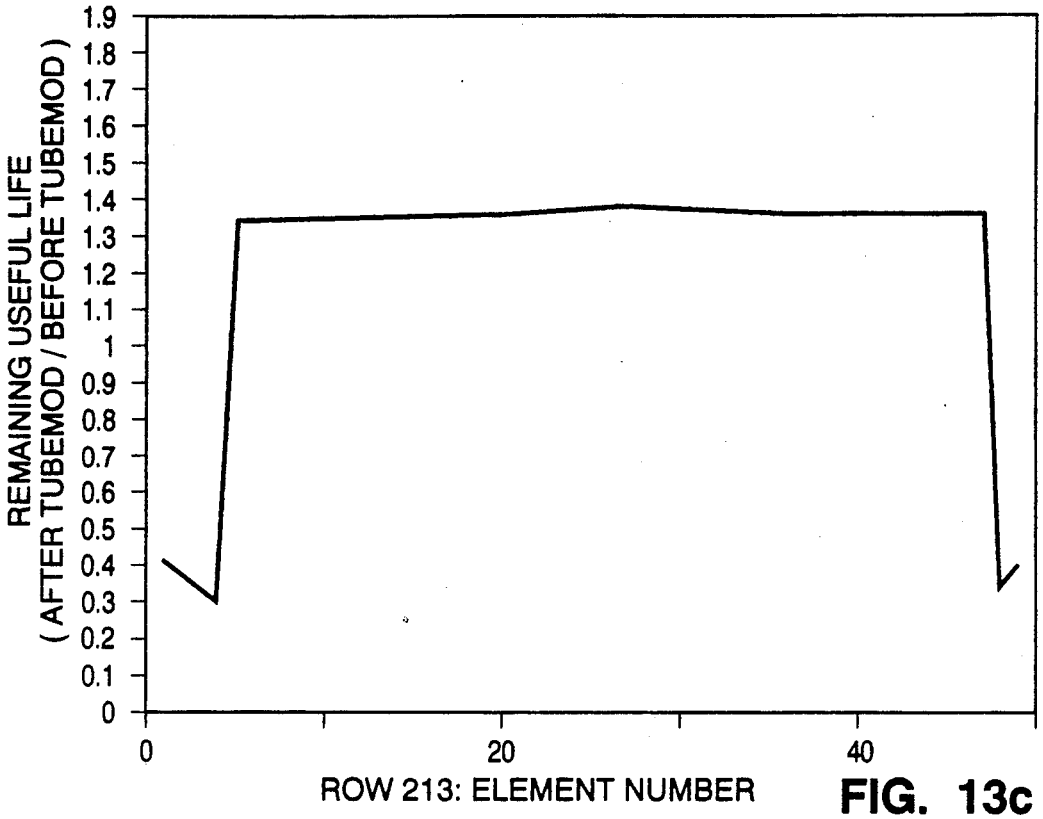
Figure 13D:
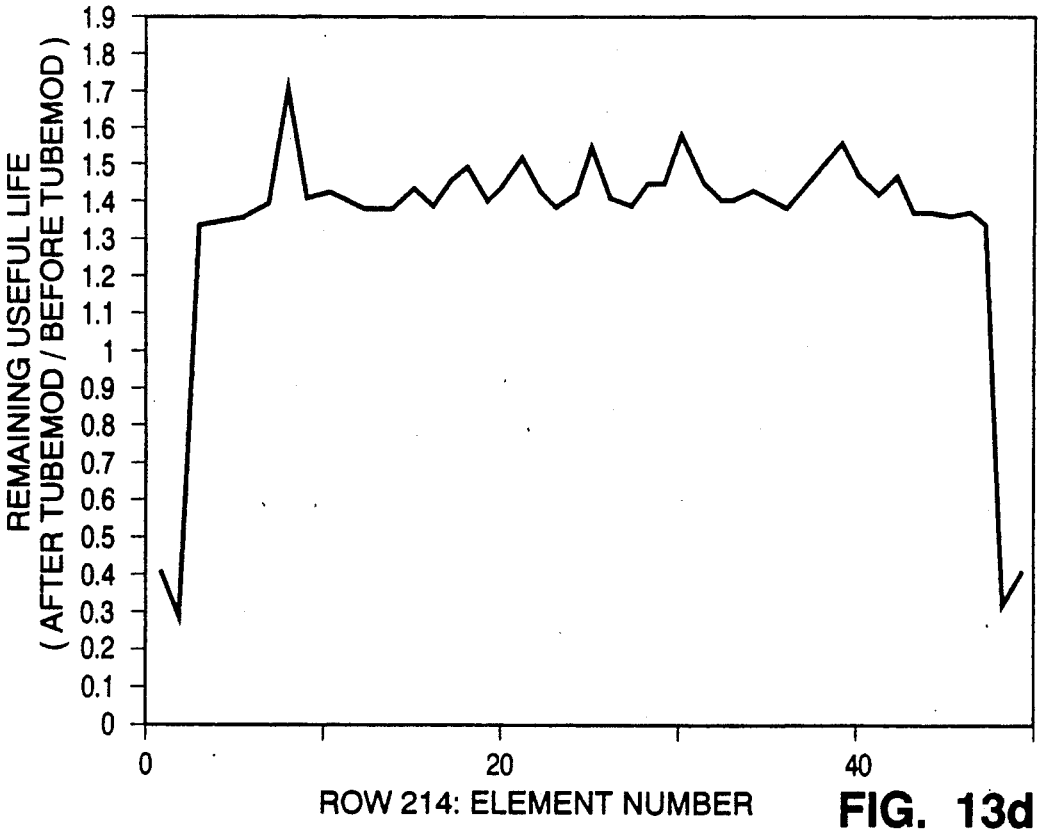

In addition, three lengths of tubing should be replaced in superheater 200 in row 214, at elements 8, 25 and 38, as illustrated in FIG. 11.

The resulting change in temperature profile is shown graphically in FIGS. 12*a* through 12*d*. Comparison with FIG. 10 shows that the tubes with SFC's (the cold tubes) have an increase in temperature, while the tubes without SFC's (the hot tubes) have a decrease in temperature. Further, the tubes with SFC's have a decrease in remaining life, while the tubes without SFC's have an increase in remaining life, as shown graphically in FIGS. 13*a* through 13*d*. However, the new remaining life for the entire section has increased and exceeds 85,000 hours. The installation also results in a pressure drop increase across the inlet and outlet headers of approximately 8 percent.

The terms and expressions which have been employed here are used as terms of description and not of limitation, and there is no intention in the use of such terms and expressions to exclude equivalents of the features shown and described, or portions thereof, it being recognized that various modifications are possible within the scope of the invention as claimed.

We claim:

1. A method of increasing the reliability and remaining useful life of a system of boiler tubes, comprising:

(a) evaluating the current condition of the tubes;

(b) obtaining the operating temperatures of the tubes;

(c) determining the flow redistribution which would be required in the tubes in order to optimize operating temperature profile; and (d) modifying the tubes to achieve said required flow distribution.

2. The method of claim 1, wherein the evaluating step comprises:

(a) examining the tubes in order to obtain measurements of oxide scale thickness and wall thickness;

(b) collecting design and operating data for the system; and (b) calculating the remaining useful life for said tubes.

3. The method of claim 2, wherein the evaluating step further comprises collecting a failure history of the system.

4. The method of claim 2, wherein the evaluating step further comprises making a visual inspection of the system to check for alignment and surface condition, including overheating damage, deposits, erosion, corrosion, and cracks.

5. The method of claim 1, wherein the evaluating step further comprises analyzing the economic benefit which can be derived by increasing the reliability and remaining useful life of said boiler tubes.

6. The method of claim 2, wherein said examining step comprises a non-destructive tube sampling technique, whereby certain of said measurements are obtained therefrom;

7. The method of claim 2, wherein said examining step comprises a destructive tube sampling technique, wherein a second plurality of boiler tubes are physically removed from the boiler and said measurements are taken therefrom.

8. The method of claim 2, wherein said examining step comprises:

(a) a non-destructive tube sampling technique, whereby certain of said measurements are obtained therefrom; and (b) a destructive tube sampling technique, wherein a first plurality of tubes are physically removed from the boiler and said measurements are taken therefrom.

9. The method of claims 6 or 8, wherein said non-destructive tube sampling technique comprises ultrasonic examination of a second plurality of boiler tubes, and whereby certain of said measurements are obtained therefrom.

10. The method of claim 2, wherein said calculating step comprises:

(a) calculating a stress value as a function of current wall thickness, estimated original wall thickness, tube pressure, and tube outside diameter;

(b) determining a current creep condition as a function of the stress value and internal oxide thickness;

(c) determining a projected creep condition as a function of oxide growth and wall thinning rates; and (d) comparing the projected creep condition to failure conditions for the selected tube material.

11. The method of claim 1, wherein said obtaining step comprises connecting a plurality of thermocouples to various points in the tubes and taking temperature readings therefrom, and recording the temperatures for use in calculations.

12. The method of claim 1, wherein said obtaining step comprises inferring tube operating temperature from measured oxide scale thickness.

13. The method of claim 1, wherein said obtaining step comprises:

connecting a plurality of thermocouples to various points in the tubes and taking temperature readings therefrom, and recording the temperatures for use in calculations; and (b) inferring tube operating temperature from measured oxide scale thickness.

14. The method of claim 1, wherein said determining step comprises:

(a) calculating an initial tube metal temperature from enthalpy and heat flow relationships;

(b) calculating tube metal temperature, scale temperature, stress, scale thickness, and creep damage for incremental increases in time;

(c) incrementing the parameters of step (b) until failure is predicted;

(d) calculating changes in future tube temperatures necessary to obtain a specified failure time;

(e) projecting steam temperature at the tube outlet based on said failure time; and (f) select optimal tube temperature profile based on steam temperature to obtain a minimum increase in pressure.

15. The method of claim 1, wherein said tubes. modifying step includes replacing certain of said 16. The method of claim 1, wherein said modifying step includes inserting a controller within certain of said tubes.

* * * * *